US012338730B2

(12) United States Patent
Cheung et al.

(10) Patent No.: US 12,338,730 B2
(45) Date of Patent: Jun. 24, 2025

(54) SYSTEM AND METHOD FOR ORIENTING AND ANCHORING DOWNHOLE TOOLS

(71) Applicant: Bright Fast International Limited, Kowloon (HK)

(72) Inventors: Paul Kwong Shun Cheung, Kowloon (HK); Dingyu Guo, Calgary (CA)

(73) Assignee: Bright Fast International Limited, Kowloon (HK)

( * ) Notice: Subject to any disclaimer, the term of this patent is extended or adjusted under 35 U.S.C. 154(b) by 0 days.

(21) Appl. No.: 18/609,788

(22) Filed: Mar. 19, 2024

(65) Prior Publication Data

US 2024/0318546 A1 Sep. 26, 2024

Related U.S. Application Data

(60) Provisional application No. 63/454,194, filed on Mar. 23, 2023.

(30) Foreign Application Priority Data

Mar. 20, 2023 (CA) ..... 3193360

(51) Int. Cl.
*E21B 47/12* (2012.01)
*E21B 7/06* (2006.01)
(Continued)

(52) U.S. Cl.
CPC ..... *E21B 47/12* (2013.01); *E21B 7/061* (2013.01); *E21B 17/046* (2013.01); *E21B 23/02* (2013.01)

(58) Field of Classification Search
USPC ..... 166/177.6
See application file for complete search history.

(56) References Cited

U.S. PATENT DOCUMENTS 4,307,780 A * 12/1981 Curington ..... E21B 47/024 175/81
5,409,060 A * 4/1995 Carter ..... E21B 10/60 166/241.1

(Continued)

OTHER PUBLICATIONS

Cheung et al., U.S. Appl. No. 63/454,194, filed Mar. 23, 2023, titled "System and Method for Orienting and Anchoring Downhole Tools", 51 pages.

*Primary Examiner* — Matthew R Buck
*Assistant Examiner* — Douglas S Wood
(74) *Attorney, Agent, or Firm* — Wells St. John P.S.

(57) ABSTRACT

System for anchoring and orienting a tool at a targeted depth and recording its angular position comprises a casing assembly including coupling joints; a position pilot joint having an anchor sleeve, guide block and spline teeth, the guide block and spline teeth resiliently supported to retract into and extend out of the sleeve. The spline teeth are attached to a synchronizing mechanism for maintaining the spline teeth in a retracted position until each spline tooth is aligned with corresponding coupling joint's recesses. As the guide block travels along the angled ramp of a coupling joint and enters the guiding slot, the position pilot and stabilizer joints correspondingly rotate. When the position pilot joint passes through its corresponding coupling joint, the spline teeth extend out of the anchor sleeve to engage the recesses. An azimuth joint is configured to record the angular orientation of the tool once the tool is anchored.

12 Claims, 28 Drawing Sheets

(51) Int. Cl.

| | |
|---|---|
| ***E21B 7/08*** | (2006.01) |
| ***E21B 17/046*** | (2006.01) |
| ***E21B 23/02*** | (2006.01) |

(56) References Cited

U.S. PATENT DOCUMENTS

| | | | | | |
|---|---|---|---|---|---|
| 5,472,048 | A | * | 12/1995 | Kennedy | E21B 33/122 166/117.6 |
| 5,477,923 | A | * | 12/1995 | Jordan, Jr. | E21B 43/14 166/384 |
| 5,579,829 | A | | 12/1996 | Comeau et al. | |
| 5,803,176 | A | * | 9/1998 | Blizzard, Jr. | E21B 10/50 166/117.6 |
| 5,806,600 | A | | 9/1998 | Halford, Sr. | |
| 5,884,698 | A | * | 3/1999 | Hughes | E21B 7/061 175/81 |
| 5,996,711 | A | | 12/1999 | Ohmer | |
| 6,279,659 | B1 | | 8/2001 | Brunet | |
| 6,315,054 | B1 | | 11/2001 | Brunet | |
| 6,564,871 | B1 | * | 5/2003 | Roberts | E21B 47/024 166/134 |
| 6,565,871 | B2 | * | 5/2003 | Roser | A61K 9/1623 424/45 |
| 8,286,708 | B2 | * | 10/2012 | Assal | E21B 23/06 166/117.6 |
| 10,954,724 | B2 | | 3/2021 | Park et al. | |
| 11,047,192 | B2 | | 6/2021 | Robertson et al. | |
| 2003/0173089 | A1 | | 9/2003 | Westgard et al. | |

* cited by examiner

SYSTEM AND METHOD FOR ORIENTING AND ANCHORING DOWNHOLE TOOLS

CROSS-REFERENCE TO RELATED APPLICATIONS

This application claims the benefit of Canadian Patent Application No. 3,193,360 filed on Mar. 20, 2023 and U.S. Provisional Application No. 63/454,194 filed on Mar. 23, 2023, both entitled "System and Method for Orienting and Anchoring Downhole Tools" and both of which are incorporated herein by reference.

FIELD

The present disclosure relates generally to systems, apparatuses and methods used in drilling horizontal wells, also known as lateral wells, from a vertical well, for purpose of producing oil and gas from subsurface formations; in particular, the present disclosure relates to systems, apparatuses and methods for locating and anchoring a downhole tool at a depth of interest, recording the lateral orientation of that tool, and for locating and re-entering a lateral well at a later time for conducting work on the lateral well.

BACKGROUND

Recently developed technologies allow several tools to self-align and guide a drill string, a casing string, coil tubing and the drill motor (also referred to herein as the progressive cavity positive displacement pump or PCPD) to a specific horizontal well location in a well containing multiple lateral wells radiating from a main vertical well bore. However, some of these technologies require a technical well for the anchor, or require specific maneuvers, performed at the surface, for aligning and guiding the drill string, casing string and/or coil tubing. Some of these technologies additionally require specialized processing on, or configuration of, components of the casing string. It is therefore desirable to provide a simplified system and tools for guiding and self-alignment of downhole tools with multiple horizontal wells without requiring specific maneuvers performed at the surface. It is additionally desirable to create a recordable and retrievable guidance system.

In U.S. Pat. No. 5,579,829 to Comeau, a keyless latch assembly aligns and fixes the axial and circumferential position of a whipstock tool within a surrounding casing joint. The alignment and fixing of the whipstock tool ensures proper engagement and orientation of a drill bit relative to an access window formed in the casing wall. Spring loaded latches in the assembly register with and extend into the corresponding receiving recesses formed on the inner surface of the casing joint. The recesses, which are spaced circumferentially around the interior of the casing joint, contain differing profiles that uniquely mate with the corresponding contoured profiles on the latches. Thus, the casing wall includes both slots and grooves of differing depths to provide a profile that matches the corresponding contoured profile on the latches, providing a two-step radial expansion of the latches into the corresponding recesses in the casing joint. The position of the latches relative to the recesses determines the amount of radial latch movement which controls the anchoring and orientation of the assembly within the casing. Confirmation of correct axial location and proper circumferential orientation may be made by monitoring of the setting string weight and turning torque from the surface.

In U.S. Pat. No. 5,806,600 to Halford, a whipstock tool has a whipstock body, a concave connected to or formed integrally of the whipstock body, and a connection apparatus for releasably connecting the whipstock body to another member. In one aspect the another member is an anchor apparatus and the connection apparatus has a shearable member that may be sheared to release the whipstock from the anchor apparatus that initially anchors the whipstock tool in a wellbore.

SUMMARY

The technology described herein provides for the guiding and self-alignment of a drill string, a casing string, coil tubing and other downhole tools with the entrances to multiple lateral wells extending from a main well bore. Additionally, the technology provides for track back and re-entering the multiple lateral wells after drilling and casing operations are completed, for example to perform cleanout and maintenance operations on the multiple lateral wells. (The terms "horizontal wells", "lateral wells", "multilateral wells" and "side legs" are used interchangeably herein). Multiple side legs or horizontal wells, radiating from a main wellbore, may be drilled into different layers of a producing formation at any time in the lifecycle of a producing well, in order to access different locations of the formation and increase production of the well. Advantageously, the systems, methods and tools described herein are not limited to use on drilling multilateral wells from a vertical wellbore, and may also be used, for example, in vertical, directional and/or horizontal drilling applications. Thus, it will be appreciated by a person skilled in the art that, although the illustrative examples and embodiments described herein are applied to the example of drilling of multilateral wells extending from a vertical wellbore, the systems and methods described herein may be adapted for use in drilling applications where additional wellbores are drilled in any direction from a first wellbore, regardless of the orientation of that first wellbore. In one aspect, to simplify the guiding of downhole tools to enter different lateral wells and create a recordable and retrievable platform, the present disclosure may provide some or all of these features.

In one aspect of the present disclosure, a system for locating a depth of interest, anchoring and orienting a well tool at the depth of interest and recording an angular orientation of the well tool is provided. In an embodiment, the system includes a casing assembly comprising a plurality of casing lengths and one or more coupling joints, each coupling joint of the one or more coupling joints having a tubular body with two opposing angled guiding ramps projecting inwardly from an interior surface of the tubular body, the two opposing angled guiding ramps converging at a guiding slot, and a plurality of longitudinal recesses adjacent the guiding slot, the plurality of longitudinal recesses for receiving a plurality of spline teeth. The system further includes a tool assembly comprising a position pilot joint at a distal end of the tool assembly, distal from the earth's surface, the position pilot joint comprising an anchor sleeve, a guide block and the plurality of spline teeth, the guide block resiliently supported so as to extend radially outwardly from an outer surface of the anchor sleeve, and the plurality of spline teeth attached to a synchronizing mechanism, the synchronizing mechanism for maintaining the plurality of spline teeth in a retracted position so as to be retracted inside the anchor sleeve until each splined tooth of the plurality of spline teeth is aligned with a corresponding longitudinal recess of the said plurality of longitudinal recesses of a corresponding coupling joint. The position pilot joint is mounted to a stabilizer joint at a distal end of the stabilizer joint, distal from the earth's surface, the stabilizer joint including an azimuth rod extending from a proximate end of the stabilizer joint that is proximate to the earth's surface, the azimuth rod operatively connected to a core rod of the stabilizer joint so as to actuate a plurality of packers of the stabilizer joint when an axial load exceeding a threshold is applied to the azimuth rod, a free end of the azimuth rod passing through an axial bore of an azimuth joint and received in a slot of the whipstock tool so as to rotate the azimuth rod when torque is applied to the whipstock tool. When the position pilot joint passes through the one or more coupling joints of the casing assembly, the plurality of longitudinal spline teeth and the guide block are each resiliently supported outwardly from the outer surface of the anchor sleeve and in sliding contact with and travelling along the interior surface of the casing assembly. When the guide block travels along the angled guiding ramp of a coupling joint of the one or more coupling joints and enters the guiding slot on the interior surface of the tubular body, the position pilot joint, the stabilizer joint and a clutch casing of an azimuth joint correspondingly rotate independently of the rotation of the whipstock tool when a clutch of the azimuth joint is in an unlocked position. When the position pilot joint passes through its corresponding coupling joint of the one or more coupling joints, the plurality of longitudinal spline teeth are synchronously and resiliently pushed radially outwardly of the outer surface of the anchor sleeve to engage the corresponding plurality of longitudinal recesses of the corresponding coupling joint. When an increasing axial load on the tool string exceeds the said threshold axial load, the core rod of the stabilizer joint actuates the stabilizer packers to engage an interior surface of the casing assembly to anchor the whipstock tool at the depth of interest.

In an embodiment, the clutch of the azimuth joint comprises an overdrive clutch mechanism comprising a clutch control sleeve at a proximal end of the azimuth joint, the clutch control sleeve cooperating with the clutch casing at a distal end of the azimuth joint. The clutch casing is attached to the proximal end of the stabilizer joint so as to rotate with the stabilizer joint and the clutch control casing includes a measurement marking for indicating an azimuth angle of the azimuth joint relative to the guiding slot of the corresponding coupling joint. The clutch control sleeve is slidingly attached to the clutch casing to rotate with the clutch casing when in a locked position and to rotate independently of the clutch casing when in an unlocked position. When the threshold axial load is applied to the azimuth rod, the locker end of the whipstock tool transmits the threshold axial load to the clutch control casing to actuate the clutch control casing into the locked position to lock and record an azimuth angle of the whipstock tool on the azimuth joint. In some embodiments, the overdrive clutch mechanism is selected from a group comprising: a roller overrunning clutch, a ratchet clutch, a friction disc clutch.

In some embodiments, each coupling joint includes a plurality of longitudinal recesses having a unique set of characteristics that corresponds to a unique set of characteristics of the plurality of spline teeth of the corresponding position pilot joint. In some embodiments, the unique set of characteristics is selected from a group comprising: length of the plurality of spline teeth and the corresponding longitudinal recesses, width of the plurality of spline teeth and corresponding longitudinal recesses, angular position of the plurality of spline teeth and corresponding longitudinal recesses relative to a guide block slot of the position pilot joint, number of spline teeth and corresponding longitudinal recesses. In some embodiments, a number of spline teeth and corresponding longitudinal recesses is selected from a range of between three and six.

In some embodiments, the synchronizing mechanism of the position pilot joint is selected from a group comprising: a linkage mechanism, a rack and pinion mechanism, a taper fit mechanism, an inclined plane fit mechanism.

In some embodiments, the whipstock tool comprises a coupling apparatus for a drill motor so as to carry and guide the drill motor to drill a lateral well laterally of the subsurface bore. In some embodiments, the whipstock tool comprises a coupling apparatus for coil tubing, the coupling apparatus including a fishing head coupled to a joint body, the joint body extending through and attached to a ring tail with releasable fasteners. When the axial load applied to the tool assembly exceeds a release threshold, the releasable fasteners release the joint body to allow the fishing head and the coil tubing to travel along the whipstock ramp to enter a targeted lateral bore. When an upward force is applied to the tool assembly to retract the coil tubing from the lateral bore towards the earth's surface, the fishing head engages the ring tail so as to retrieve the whipstock tool to the earth's surface.

In some embodiments, the position pilot joint is an adaptable position pilot joint. The adaptable position pilot joint comprises a plurality of guide blocks, the plurality of guide blocks operatively engaged with a rotatable knob assembly. The rotatable knob assembly includes a spiral lip for releasing one selected guide block of the plurality of guide blocks to allow the selected guide block to extend radially outwardly of the anchor sleeve while retaining the other guide blocks of the plurality of guide blocks within the anchor sleeve, to thereby change a relative angular position of the plurality of spline teeth and the guide block of the plurality of guide blocks.

In some embodiments where the position pilot joint is an adaptable position pilot joint, the plurality of spline teeth comprise modular spline teeth. Each spline tooth of the modular spline teeth comprises a spline tooth body and at least two exchangeable tails. Each tail of the at least two exchangeable tails has a characteristic that is different from the characteristics of the other exchangeable tails, and a coupling for coupling the exchangeable tail to the spline tooth body. In some embodiments, the characteristics of the exchangeable tails are selected from a group comprising: length, width.

It will be appreciated that components of the system described above may be used apart from the other components of the system. For example, not intended to be limiting, the position pilot joints (including the adaptable position pilot joints) may be used together with a casing assembly comprising a plurality of casing lengths and one or more coupling joints, so as to automatically locate and orient other types of downhole tools at a particular measurement depth and angular position within the wellbore, and these components may be used with different types of anchors or stabilizing joints and other types of downhole tools, including but not limited to other whipstock tools. As another example, not intended to be limiting, the azimuth joint described herein may be used with other stabilizer joints and/or other position pilot joints that are used for locating and anchoring a downhole tool at a measured depth in the wellbore, and the azimuth joint as disclosed herein may be used with such other components to automatically record the angular position of a downhole tool, once the downhole tool has been located and anchored within the wellbore.

DETAILED DESCRIPTION

Figure 1:
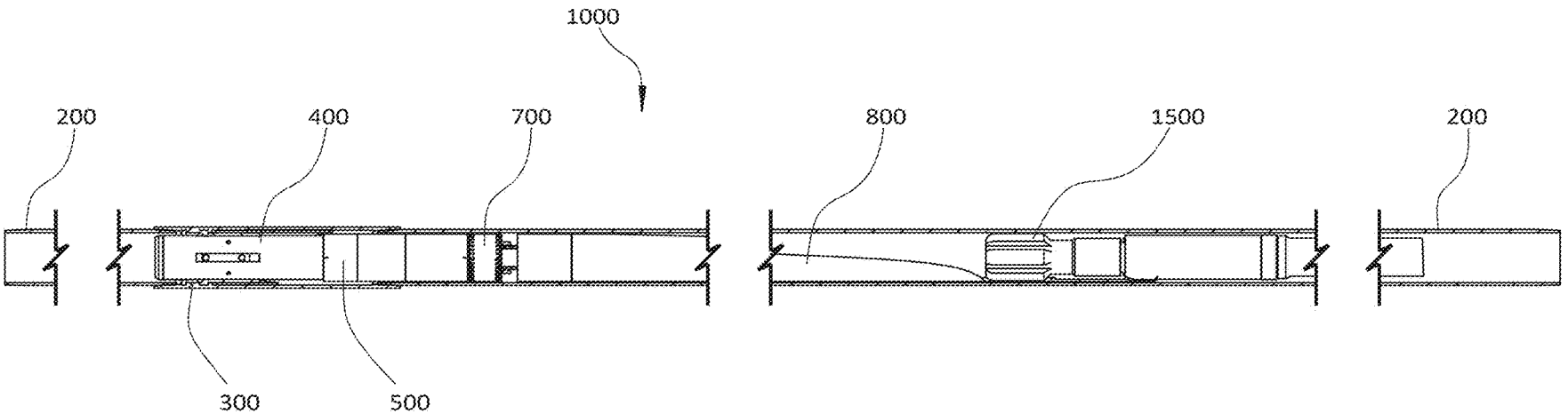
FIG. 1 is a sectional break view of an embodiment of the tool assembly.

In an aspect of the present disclosure, a system for locating and anchoring a downhole tool at a depth of interest includes a casing assembly comprising a plurality of casing lengths and one or more coupling joints, the coupling joints having features on the inner walls of the tubular body of each coupling joint for automatically rotating and guiding a guide block of a corresponding position pilot joint. The position pilot joint is attached to the distal end of a downhole tool assembly 1000, an example of which is illustrated in FIG. 1. As will be further explained below, the guiding features on the inner walls of the coupling joint are configured to automatically rotate and guide the guiding block on the position pilot joint, the guide block being resiliently supported on, and extending radially outwardly from, the sleeve of the position pilot joint, which thereby causes the position pilot joint to rotate as the guide block travels along the guiding features on the inner walls of the coupling joint. The guiding features of the coupling joint also include a unique set of mating features that uniquely correspond to a configuration of spline teeth of the position pilot joint, such that the spline teeth of the position pilot joint will only engage with, so as to lock into, the mating features on a corresponding coupling joint, while allowing the position pilot joint to slide past other coupling joints which do not possess the corresponding mating features that match the configuration of spline teeth on the position pilot joint. In this manner, the combination of the guiding block on the position pilot joint and the guiding features on the inner walls of the coupling joint provide for the position pilot joint to automatically rotate into the desired angular orientation, without having to manually rotate or otherwise manipulate the position pilot joint from the surface in order to accomplish locking the position pilot joint into the desired coupling joint.

In one aspect, the measured depth of each coupling joint is determined at the time the casing string is assembled at the surface, prior to running the casing string down the wellbore. Therefore, each coupling joint is positioned in the wellbore at a measured depth of interest in order to locate the whipstock tool at the desired measured depth, so that the whipstock tool is positioned adjacent to a targeted layer of the formation that will be drilled into, laterally of the main wellbore. Thus, positioning the downhole tool at a measured depth of interest is advantageously accomplished without having to perform any special maneuvers at the surface, such as rotating or pulling up on the drill string to confirm the position pilot joint has mated with the corresponding coupling joint. From the surface, it is determined that the downhole tool, such as a drill motor or a coil tubing, has begun to drill the targeted lateral wellbore, or has otherwise run into the targeted lateral wellbore previously drilled, based on measuring depth of the downhole tool assembly, since the depth of each coupling joint in the casing string was previously determined at the time the casing string was assembled. Where a new lateral wellbore is to be drilled, once the tool assembly has reached the desired measured depth and the position pilot joint mated with the corresponding coupling joint, and the connected stabilizer joint has been actuated, readings obtained from the azimuth angle and inclination angle values obtained from the MWD tool, as would be known to a person skilled in the art, are used to steer the drilling of the lateral wellbore. Additionally, an azimuth joint, which forms a part of the tool assembly and coupled to the stabilizer joint, automatically records the azimuth angle of the orientation of the whipstock tool when sufficient axial load has been applied to the tool assembly to actuate the azimuth joint into a locked position, as will be further described below. This recorded azimuth angle indicates the azimuth angle of the whipstock tool, and therefore of the lateral wellbore to be drilled, and the recorded azimuth angle may be subsequently read and recorded at the surface when the tool assembly is retrieved from the wellbore.

In another aspect of the present disclosure, when it is desired to re-enter a previously drilled lateral well, the tool assembly may be assembled by selecting the configuration of the position pilot joint that corresponds to the coupling joint that is positioned at the depth of the targeted lateral well to be entered, and the azimuth joint is adjusted to set the angle of the azimuth joint at the previously recorded azimuth angle of the targeted lateral well, and then the azimuth joint is actuated into a locked position. Because the azimuth joint is in a locked position, the whipstock tool will rotate along with the position pilot joint, the stabilizer joint and the azimuth joint in the tool assembly while the tool assembly is run downhole, thereby orienting the whipstock tool into the correct angular position when the position pilot joint is mated with the corresponding coupling joint of the targeted lateral wellbore. This is because the whipstock tool rotates along with the position pilot joint as the position pilot joint rotates to follow the guide block along the guiding features of the coupling joint, thereby rotating the whipstock tool to the desired angular orientation. Thus, once the position pilot joint and the stabilizer joint are located at the correct measured depth for the targeted lateral wellbore, and locked into position, the whipstock tool will be automatically oriented in the correct angular position for the downhole tool, such as a coil tubing, to enter into the targeted lateral wellbore.

In another aspect of the present disclosure, the azimuth joint automatically records the azimuth angle of the azimuth joint relative to the angular position of the whipstock, and therefore also records the angular position of the whipstock relative to the position of the guiding slot on the corresponding coupling joint. Thus, when the drilling string is pulled out of the wellbore, the azimuth angle as recorded by the azimuth joint is noted, which allows the driller to know the angular location of, and thereby re-enter, the lateral wellbore at a later time.

Referring to the Figures, it will be appreciated that the terms "bottom side" and "top side" are included in some of the Figures to assist the reader in understanding the orientation of the features illustrated in the drawings when the tools are in use, relative to the earth's surface. For example, "bottom side" refers to the end of a tool or joint that is located distal from, or in other words farthest from, the entrance to the wellbore at the Earth's surface. The term "top side" refers to the opposite end of the tool or joint, opposite from the "bottom side" end, that is located proximate to, or in other words closest to, the entrance to the wellbore at the Earth's surface.

As shown in FIG. 1, an example of a tool assembly 1000 is illustrated, and the components of a system for locating and anchoring a downhole drilling tool include the following: at the distal end of the drilling string, distal from the surface, a position pilot joint 400 is adapted to mate with a corresponding coupling joint by the specific configuration of the position pilot joint's spline structure, as will be further explained below. The position pilot joint 400 is coupled to a stabilizer joint 500 through, for example, a threaded connection on an anchor sleeve 406 of the position pilot joint (see FIG. 11B). The stabilizer joint 500 is coupled to an azimuth joint 700 through, for example, a threaded coupling on the stabilizer sleeve 503 (see FIG. 19B). The stabilizer joint 500 includes an azimuth rod 501 that passes through a central bore 709 of the azimuth joint, and is received by an inner hex slot 802*a* on the whipstock body 802 of a direction wedge or whipstock tool 800 (see FIGS. 19B and 21). The whipstock 800 may be coupled to, for example, a PCPD or coil tubing via a coupling apparatus 803 or 804 on the whipstock tool 800. Both embodiments 803 and 804 may hold the PCPD or coil tubing, respectively, by shear bolts 805.

Regarding the PCPD coupling apparatus 804 (see FIGS. 23-24A), an extension rod 806 may be welded onto the whipstock body 802 at one end. The other end of the extension rod 806 is fastened to a joint sleeve 807. The joint sleeve 807, in turn, is threaded onto the stabilizer connection of a regular drill motor or PCPD 1500 (see FIGS. 1 and 24A). The locking ring 808 is also threaded onto the stabilizer connection of a regular drill motor 1500. It will be appreciated that any references to a "threaded connection"

herein are provided as an example only, and that the different components of each joint or tool in the present disclosure may be assembled together using other methods as would be known to a person skilled in the art.

Coupling Joints

In one aspect, the coupling joints and the corresponding position pilot joints allow a drilling crew to locate and position drilling tools at different measurement depths of interest. The coupling joints and position pilot joints perform this locating function automatically, in that the position pilot joint will be automatically rotated into the correct angular position as it passes through its corresponding coupling joint, and the position pilot joint will automatically mate with its corresponding coupling joint without the drilling crew needing to perform any specific procedures at the surface, such as pulling up on or rotating the drilling string or tool assembly from the Earth's surface. Additionally, where it is desired to locate drilling tools at different measurement depths in the wellbore during drilling procedures, this may be accomplished by adding multiple coupling joints to the casing string such that each coupling joint will be located at a targeted measurement depth when the casing string is run downhole. Because each coupling joint has unique mating features that differentiate it from the other coupling joints in the casing string, the drilling crew may locate a drilling tool at a particular targeted depth by selecting the position pilot joint that corresponds to, and will automatically mate with, the coupling joint that is located at the targeted depth in the casing string. Advantageously, the position pilot joint is designed to pass through coupling joints that do not have the unique set of mating features corresponding to that particular position pilot joint, so that mating will only occur when the position pilot joint passes through its corresponding coupling joint. As explained below, there are many different combinations of mating features that may be used to create unique pairs of casing joints and corresponding position pilot joints.

Figure 2:
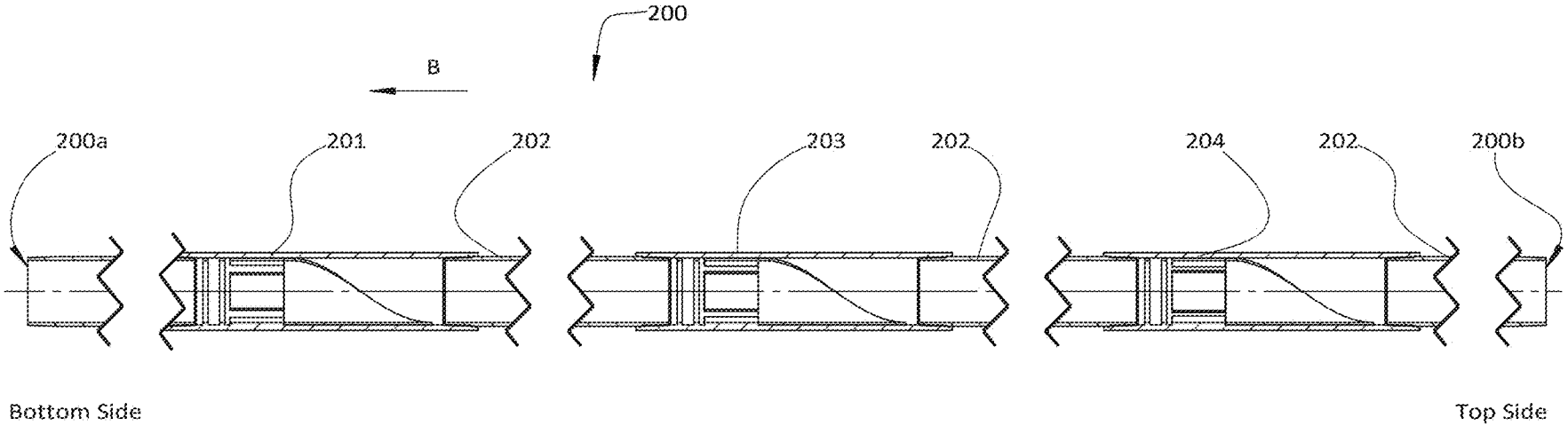
FIG. 2 is a break view of an embodiment of a coupling setting, including embodiments of three coupling joints, in accordance with an embodiment of the present disclosure.
Figure 3C:
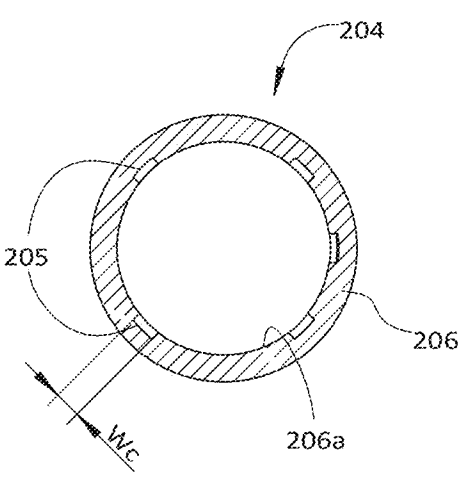
FIGS. 3A to 3C are sectional views of the coupling setting of FIG. 2, taken along lines A-A, B-B and C-C of FIG. 2, respectively.
Figure 3B:
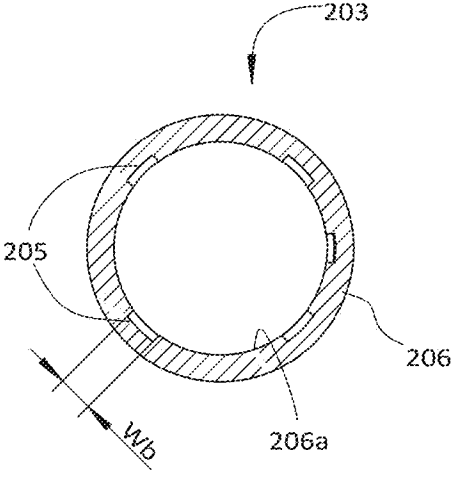
Figure 3A:
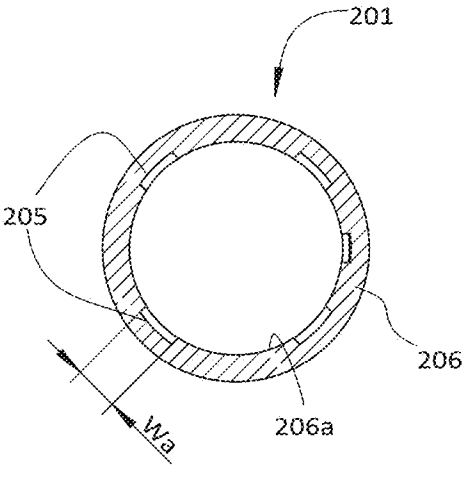

Referring to FIGS. 2-3C, an illustrative example of three different coupling joints 201, 203 and 204, in accordance with an embodiment of the present disclosure, are illustrated; the coupling joints 201, 203 and 204 are joined together with lengths of casing 202. The lengths of casing 202 may be made of steel or fibreglass, for example. As best viewed in FIGS. 3A to 3C, each coupling joint has a set of four longitudinal grooves 205 on the interior surface 206*a* of the tubular body 206 of the coupling joint. These longitudinal grooves 205 are an example of the unique mating features that may be employed on different embodiments of the coupling joint. In this example, the coupling joints 201, 203 and 204 are differentiated from each other by the width of the grooves 205. For example, coupling joint 201 has a groove width $W_a$ that exceeds the width $W_b$ of coupling joint 203, and the width $W_b$ of coupling joint 203 exceeds the width $W_c$ of the grooves 205 on coupling joint 204.

Thus, in the example of a casing string 200 shown in FIG. 2, the coupling joint 204 having the smallest width $W_c$ of the longitudinal grooves 205 is positioned closest to the proximate end 200*b* of the casing string, which is the end of the string that is closest to the surface when the casing string is run downhole. The next coupling joint 203, which is downstream of the coupling joint 204, has a larger width $W_b$ for the longitudinal grooves 205, and then the next coupling joint 201, having the largest width $W_a$ of the three coupling joints, is downstream of the coupling joint 203 and is positioned proximate the distal end 200*a* of the casing string 200, the distal end 200*a* being distal from the surface when the casing string is run downhole.

In operation, the casing string 200 is assembled at the surface, with each of the coupling joints positioned in the casing string at targeted measured depths in accordance with the well plan, which may include certain requirements, such as having sufficient spacing between two side legs to be drilled, the measurement depth, and other requirements. In one aspect of the present disclosure, the position for anchoring the downhole tools prior to drilling a side leg is selected using the relative benchmark status method, meaning that only the measured depth of the targeted side leg to be drilled is determined and fixed, relative to the Earth's surface, whereas the circumferential orientation of the side leg to the drilled is not determined and fixed, relative to the Earth's surface, when the casing string is assembled. This means that the circumferential orientation of the side leg to be drilled, or in other words the direction of the window opening through the casing, is determined after the tools are anchored into place at the targeted measured depth, with the direction of the window opening determined by using measurement while drilling (MWD) tools to steer the direction of the drilling, as would be known to a person skilled in the art. Thus, as will be further explained below, the azimuth joint in the tool assembly 1000 is used, during drilling operations, to record the circumferential orientation of the window opening by recording the azimuth angle of the whipstock tool 800 when the azimuth tool is actuated into the locked position, and the recorded azimuth angle is subsequently read at the surface when the tool assembly 1000 is retrieved to the surface. This is in contrast to the absolute benchmark status method, in which both the measurement depth and the window opening direction are determined for each side leg at the surface when constructing the casing string. Thus, in one aspect of the present disclosure and as further explained below, there is no specific requirement for choosing a particular circumferential orientation of each coupling joint when assembling the casing string; only the measured depth of each coupling joint is taken into consideration when assembling the casing string. Once assembled, the entire casing string 200 is run downhole.

Figure 25A:
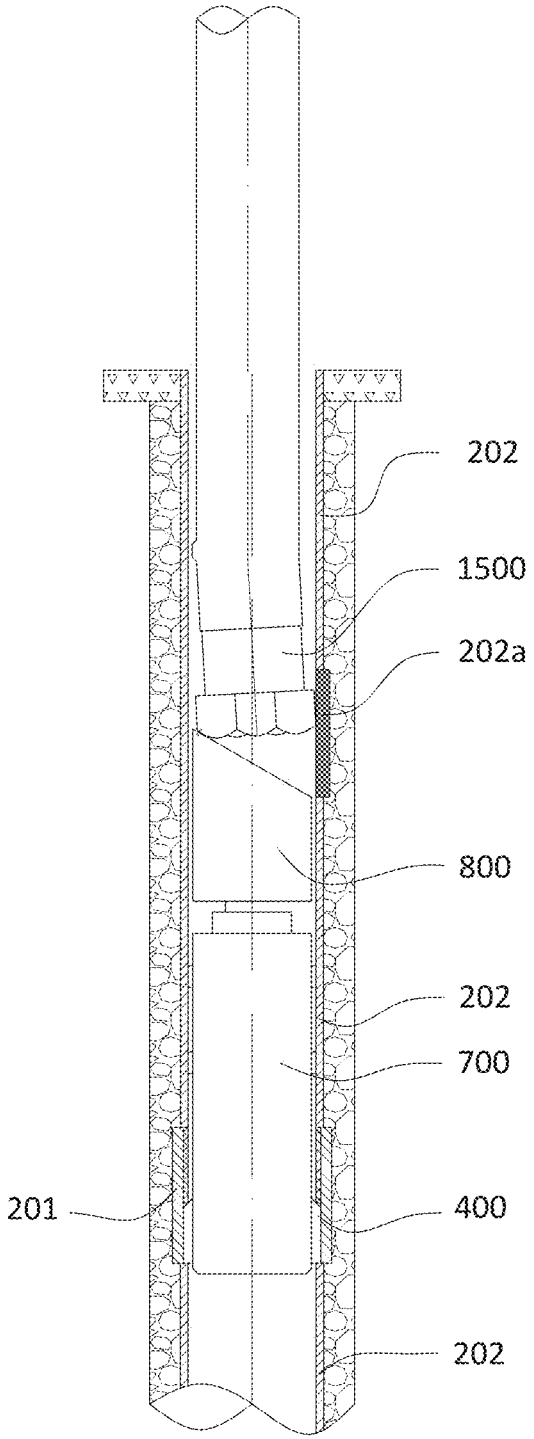
FIGS. 25A and 25B are simplified side elevation, sectional views showing the process of opening a window in the casing, in accordance with one aspect of the present disclosure.
Figure 25B:
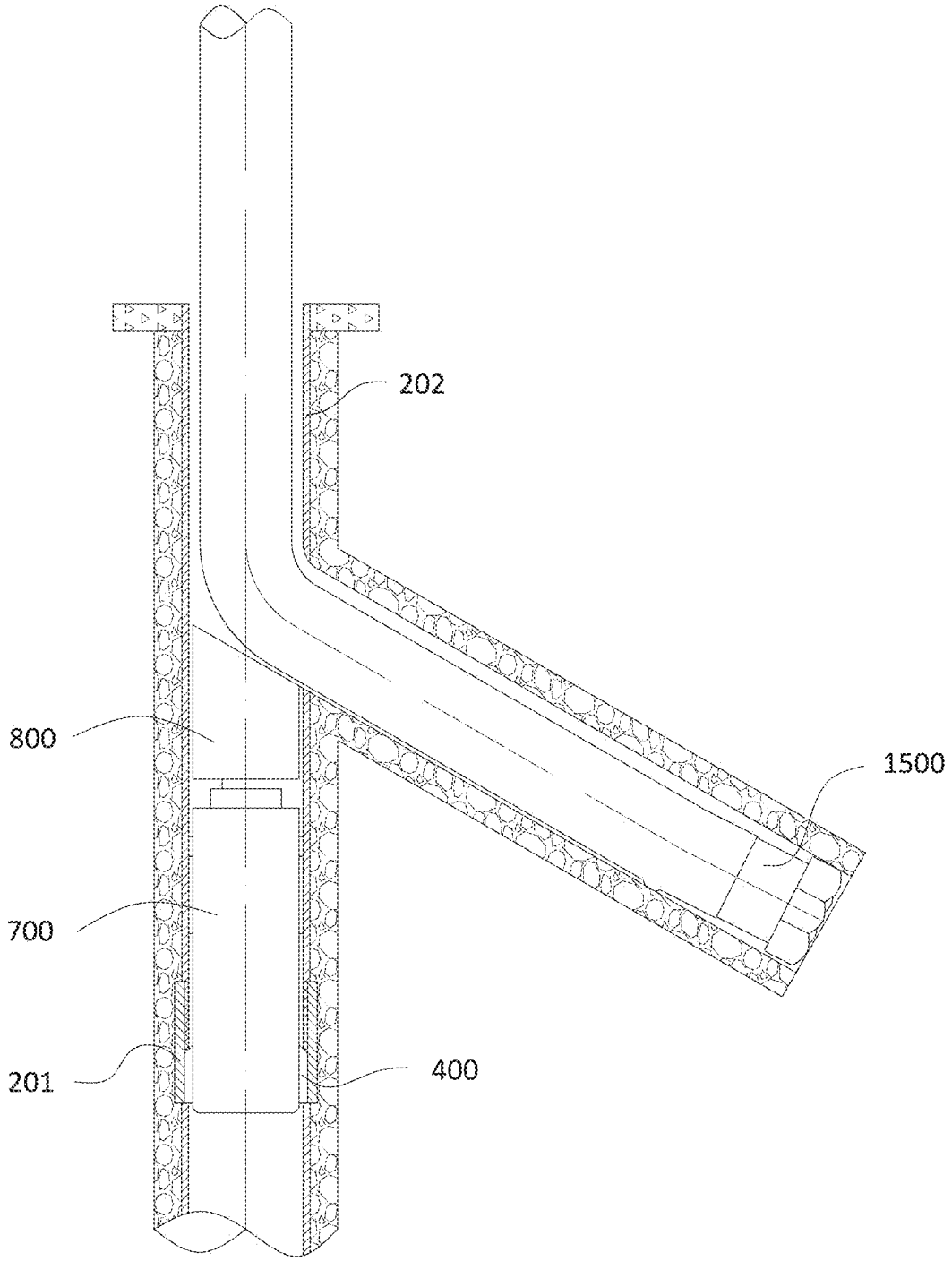

The coupling joints 201, 203, 204 are connected together along with sections of regular casing or other oil country tubular goods (OCTG) 202. The OCTG may include, for example, a casing pipe manufactured of steel, fiberglass, other suitable materials known to a person skilled in the art, or any combination thereof. In some embodiments, the position of the coupling joints in the casing string 200 is selected for locating drilling tools at a selected measured depth of the wellbore, including for example whipstock tools for drilling horizontal legs of the well. Thus, the window openings for drilling through the casing string may be incorporated into the OCTG casing 202 of the casing string 200, as best viewed in the schematic illustration of FIGS. 25A and 25B. For example, as shown in FIG. 25A, the position pilot joint 400 is mated with its corresponding coupling joint 201 (as will be further explained below), and thereby the whipstock tool 800 is positioned and anchored into its desired position in the well, adjacent a portion of the OCTG casing 202*a* for drilling the window opening for the horizontal leg. FIG. 25B illustrates the horizontal leg that was drilled by the drill motor and bit assembly 1500.

Figure 4:
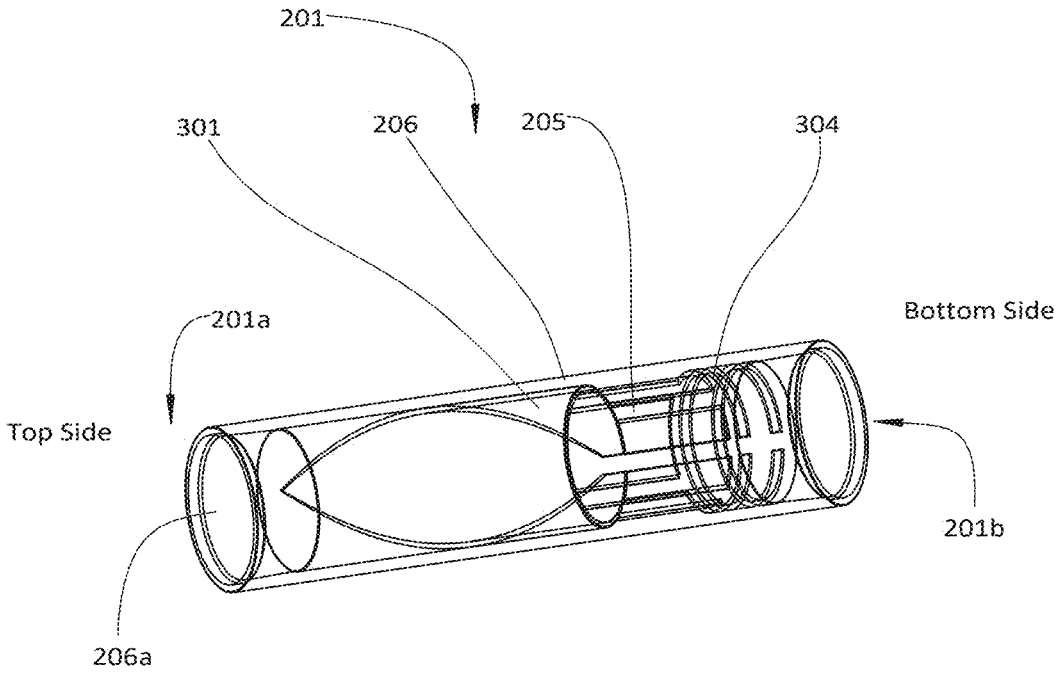
FIG. 4 is a perspective view of an embodiment of the coupling joint.
Figure 5A:
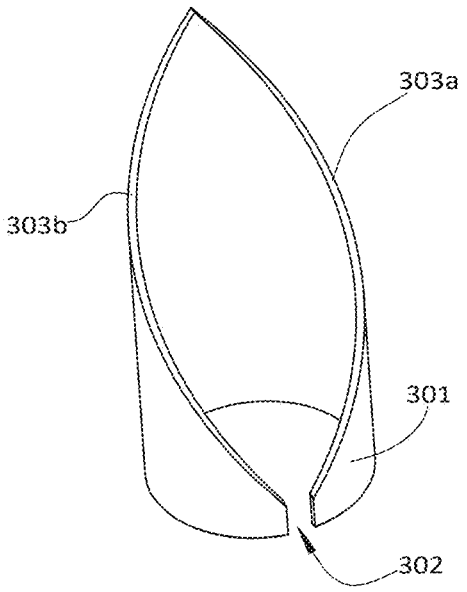
FIGS. 5A and 5B are perspective views of the Mule Shoe and the coupling joint tubular body, respectively, which together form the coupling joint of FIG. 4.
Figure 5B:
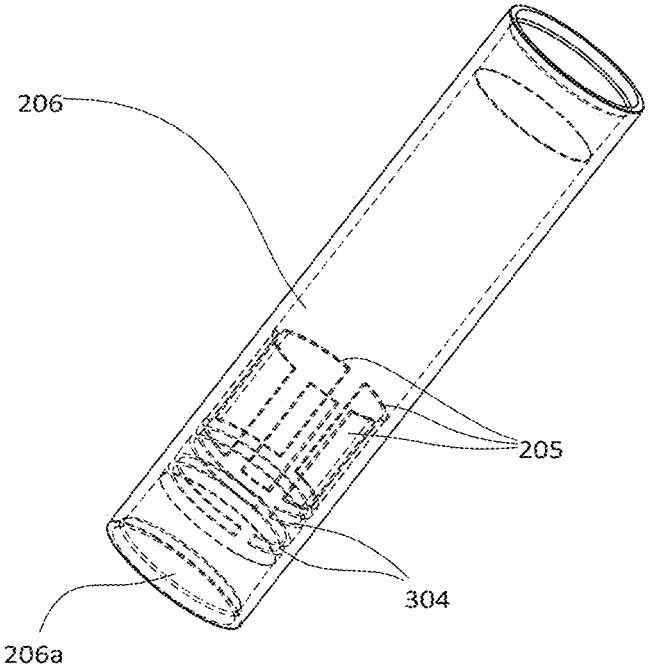

Illustrated in FIGS. 4 to 5B is an example of a coupling joint 201. The coupling joint, in some embodiments, includes a Mule Shoe portion 301 welded onto the inner surface of the coupling joint's tubular body 206. FIG. 5A shows the Mule Shoe portion 301 separated from the tubular body 206, which is illustrated in FIG. 5B, whereas the fully assembled coupling joint 201 is illustrated in FIG. 4. The Mule Shoe portion 301 includes a pair of ramp edges 303*a*, 303*b* which converge to a guiding slot 302. The tubular body 206 includes a plurality of longitudinal slots 205, the longitudinal slots 205 machined into the inner surface 206*a* of the tubular body 206. Additionally, there are a series of circumferential grooves 304 located downstream of the longitudinal slots 205, the circumferential grooves 304 are also machined into the inner surface 206*a* of the tubular body 206. When positioned in the casing string 200, the coupling joint 201 would be oriented such that the proximate end 201*a* would be proximate to the surface, and the distal end 201*b* would be proximate to the distal end 200*a* of the casing string 200, distal from the surface. Thus, when the position pilot joint 400 passes through the coupling joint 201, the position pilot joint would enter the coupling joint at the proximate end 201*a* and exit through the distal end 201*b*, if the coupling joint 201 does not correspond to that particular position pilot joint 400. On the other hand, if the spline teeth of the position pilot joint 400 correspond to the plurality of longitudinal slots 205, such that the spline teeth of the position pilot joint 400 fit into and mate with the longitudinal slots 205 of the coupling joint, then the position pilot joint will automatically mate with, and lock into, the coupling joint 201 as the position pilot joint passes through the coupling joint.

Although the illustrated embodiments of coupling joints 300, described herein, comprise of a Mule Shoe 301 assembled together with a tubular body 206, so as to form ramp edges 303*a*, 303*b* along the inner surface 206*a* of the tubular body 206, it will be appreciated that the coupling joint 300 may be manufactured in other ways to form the ramp edges 303*a*, 303*b* and the guiding slot 302 on the inner surface 206*a* of the tubular body 206, and that any other manufacturing methods known to a person skilled in the art to manufacture such a coupling joint 300 are included in the scope of the present disclosure.

Position Pilot Joints

An embodiment of a position pilot joint 400 is illustrated in FIGS. 11A to 12B. The position pilot joint 400 includes a guide block 402 and a plurality of spline teeth 407, each of the guide block 402 and the spline teeth resiliently supported on an anchor mandrel 404 by resilient members, such as springs 403. The anchor mandrel 404 is concentrically assembled with an anchor sleeve 406, the anchor sleeve 406 having a guide opening 406*a* for guiding the guide block 402 as it slides radially into and out of the anchor sleeve 406, and a plurality of spline openings 406*b* to guide the plurality of spline teeth 407 as they slide radially into and out of the anchor sleeve 406, as best viewed in FIG. 12A. As best viewed in FIG. 11B, the springs 403 resiliently support the guide block 402 and the spline teeth 407 within the anchor sleeve 406 and allow the guide block 402 and the spline teeth 407 to project radially outwardly of the anchor sleeve 406, past the outer surface 406*c* of the anchor sleeve 406.

Figure 11B:
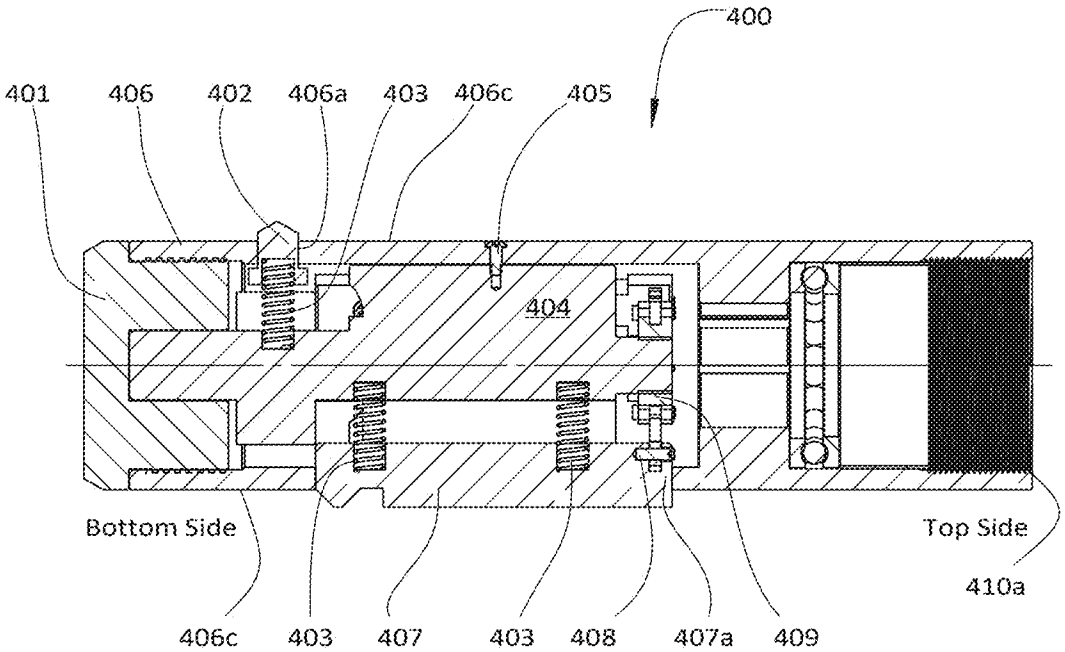
FIG. 11B is an axial section projection view of the position pilot joint of FIG. 11A, taken along line 11B-11B.
Figure 11A:
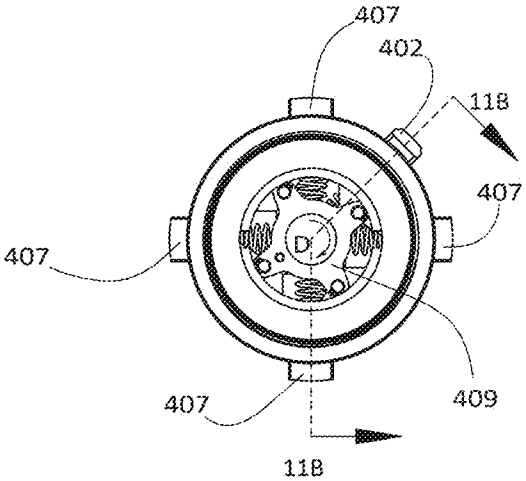
FIG. 11A is a top elevation view of an embodiment of the position pilot joint.
Figure 12A:
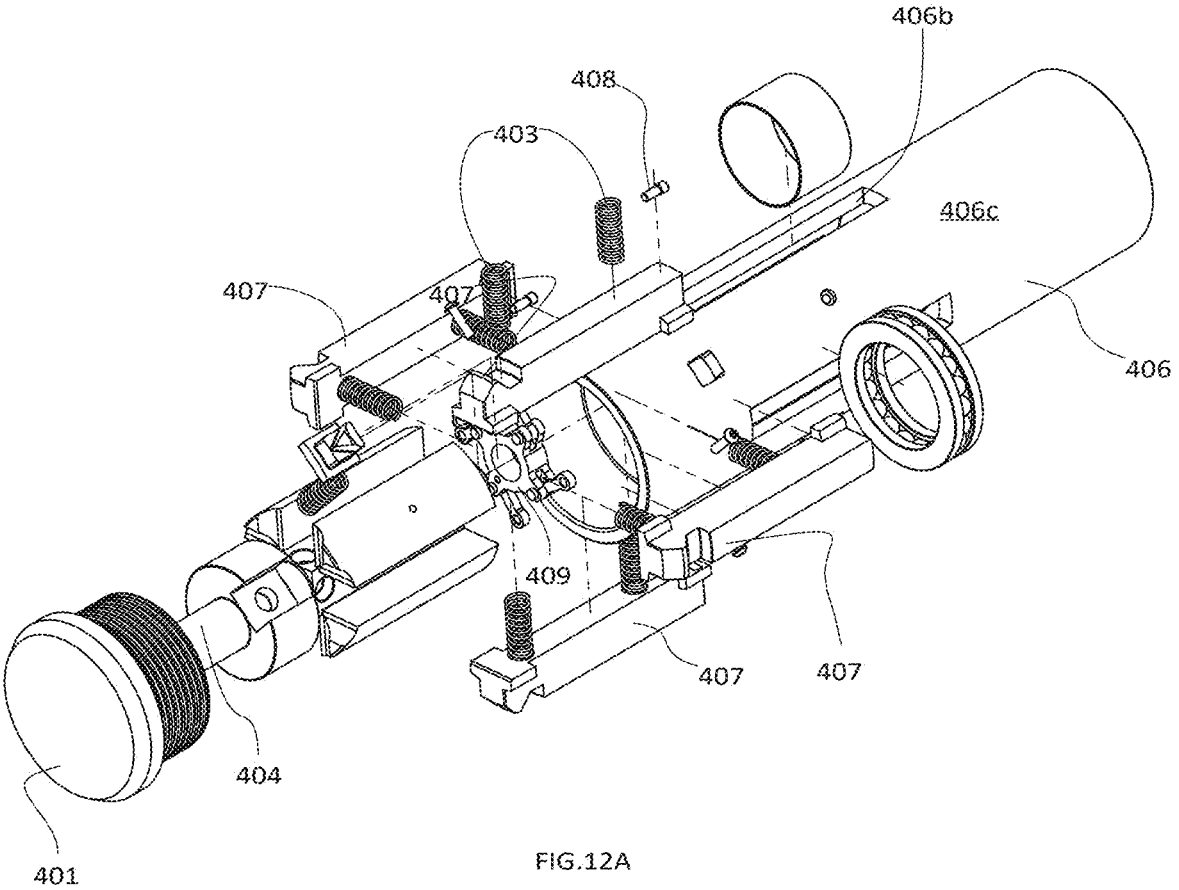
FIG. 12A is an exploded, perspective view of the position pilot joint shown in FIGS. 11A and 11B.
Figure 12B:
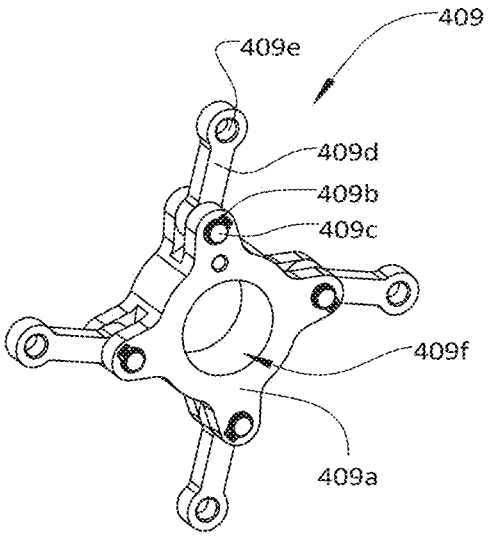
FIG. 12B is a perspective view of an embodiment of a synchronizer assembly of the position pilot joint shown in FIG. 12A.

Additionally, the spline teeth 407 are each connected, at a synchronizer end 407*a* of each spline tooth 407, to a synchronizer 409. In an embodiment of the synchronizer 409, illustrated in FIGS. 11A to 12B, the synchronizer comprises a body 409*a*, the body 409*a* pivotally connected to a plurality of arms 409*d*. The arms 409*d* are each pivotally attached to the body 409*a* with a pin 409*c* and a retaining ring 409*b*. The number of arms 409*d* corresponds to the number of spline teeth 407 of the position pilot joint 400; in the illustrated embodiment, there are four arms 409*d* of the synchronizer 409, for synchronizing the four spline teeth 407. Each synchronizer arm 409*d* includes an aperture 409*e* at the distal end of the arm, distal from the synchronizer body 409*a*. Additionally, there is a central bore 409*f* through the center of the body 409*a*, which allows the synchronizer to be mounted onto the synchronizer end 404*a* of the anchor mandrel 404, as shown in FIG. 11B. Each of the spline teeth 407 is pivotally coupled to an arm 409*d* of the synchronizer, by a drive pin 408 inserted through the aperture 409*e* and the spline tooth 407, as shown in FIG. 11B. The embodiment of the synchronizer 409 illustrated is based on a slider crank mechanism, whereby the movement of the plurality of spline teeth 407 is synchronized such that the spline teeth 407 will only project out of the anchor sleeve 406 if all the spline teeth 407 are able to project into a corresponding longitudinal slot 205 of the corresponding coupling joint 201, 203 or 204. Whereas, if one or more of the spline teeth 407 are not adjacent to a corresponding longitudinal slot 205 as the position pilot joint slides through the coupling joint 201, then all of the spline teeth 407 will be retained within the anchor sleeve 406 by the synchronizer 409.

The guide block 402 of the position pilot joint, which is resiliently supported on the mandrel 404 to slide through the opening 406*a* in the anchor sleeve 406 and project beyond the outer surface 406*c* of the anchor sleeve, travels along the inner surface 206*a* of the tubular body 206 of coupling joint 201 until the guide block 402 encounters a ramp edge 303 of the Mule Shoe portion 301. The guide block 402 is then guided along the ramp edge 303 towards the guiding slot 302, causing the position pilot joint 400 to rotate along its central axis A as the guide block 402 maintains contact with the ramp edge 303. At the same time, the spline teeth 407 are partially recessed within the anchor sleeve 406, as the spline teeth slide along and are in contact with the interior surface of the coupling joint 201. When the guide block 402 reaches the guiding slot 302, it is guided through the guiding slot 302, at which point the position pilot joint 400 has been rotated to a mounted orientation. As the position pilot joint 400 continues travelling through the coupling joint 201 in direction B, the plurality of spline teeth 407 will slide along and become adjacent to the plurality of longitudinal slots 205 of the coupling joint 201. If each tooth of the plurality of spline teeth 407 matches the plurality of longitudinal slots 205 of the coupling joint, the spline teeth 407 will extend through their respective apertures 406*b* in the anchor sleeve 406 and into, so as to mate with, the longitudinal slots 205 of the coupling joint 201. However, because each spline tooth 407 is coupled to an arm 409*d* of the synchronizer 409, the spline teeth 407 will not fully extend into the longitudinal slots 205 unless all of the spline teeth 407 are a match with a corresponding longitudinal slot.

Figure 13B:
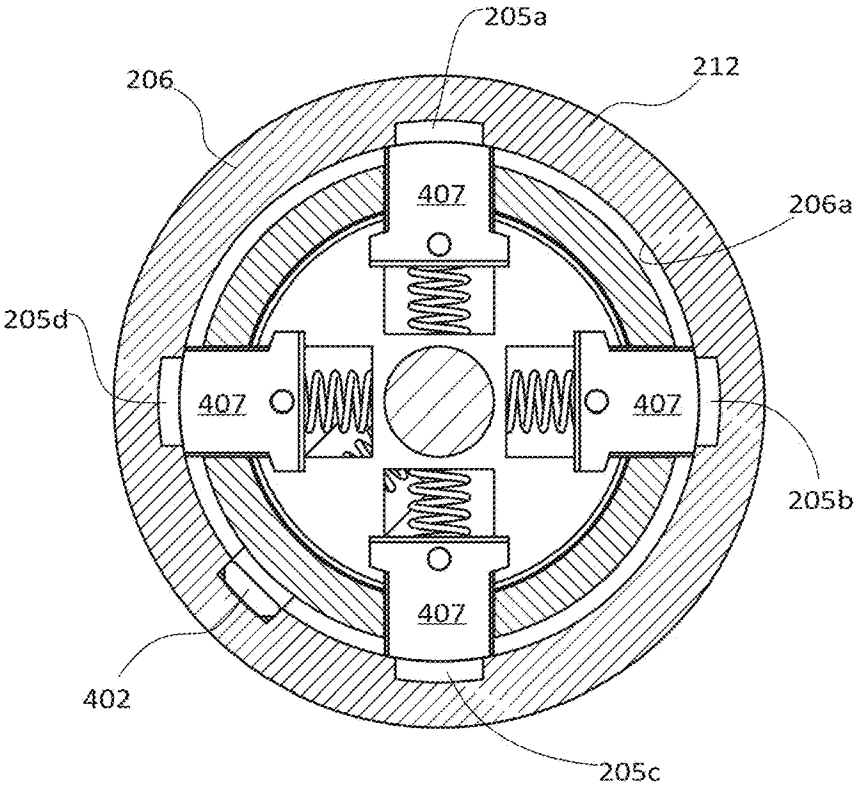
FIGS. 13A to 13D are sectional views of different examples of position pilot joints interacting with coupling joints.
Figure 13A:
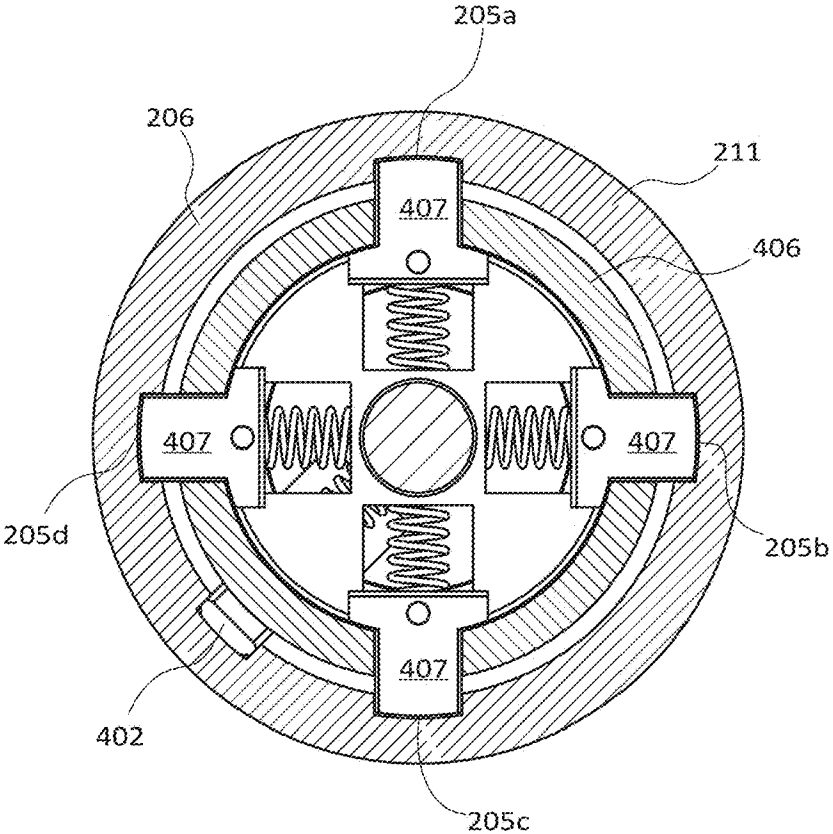

FIGS. 13A to 13D are cross-sectional views of a position pilot joint 400 passing through different coupling joints. FIGS. 13A and 13B are examples of one embodiment of a position pilot joint 400 having spline teeth 407 of a given width, passing through two different coupling joints, referred to here as coupling joints 211 and 212. In the cross-sectional views of FIGS. 13A and 13B, the synchronizer 409 is not visible. In FIG. 13A, the position pilot joint 400 is passing through a coupling joint 211 that includes four longitudinal slots 205*a* to 205*d* that each have a width that is slightly less than the width of the corresponding four spline teeth 407. Thus, when this position pilot joint 400 passes through the coupling joint 211, the spline teeth 407 synchronously extend radially outward from the anchor sleeve 406 and are inserted into the corresponding longitudinal slots 205*a* to 205*d* that are recessed in the tubular body 206 of the coupling joint 211. However, as shown in FIG. 13B, when the same position pilot joint passes through a different coupling joint 212 having four longitudinal slots 205*a* to 205*d* that are narrower in width than the four spline teeth 407, the spline teeth 407 are prevented from extending into the longitudinal slots 205*a* to 205*d*, although the spline teeth 407 remain in sliding contact with the interior surface 206*a* of the tubular body 206 of coupling joint 212. Thus, the position pilot joint will slide through the coupling joint 212 without engaging the spline teeth with the longitudinal slots.

Figure 13D:
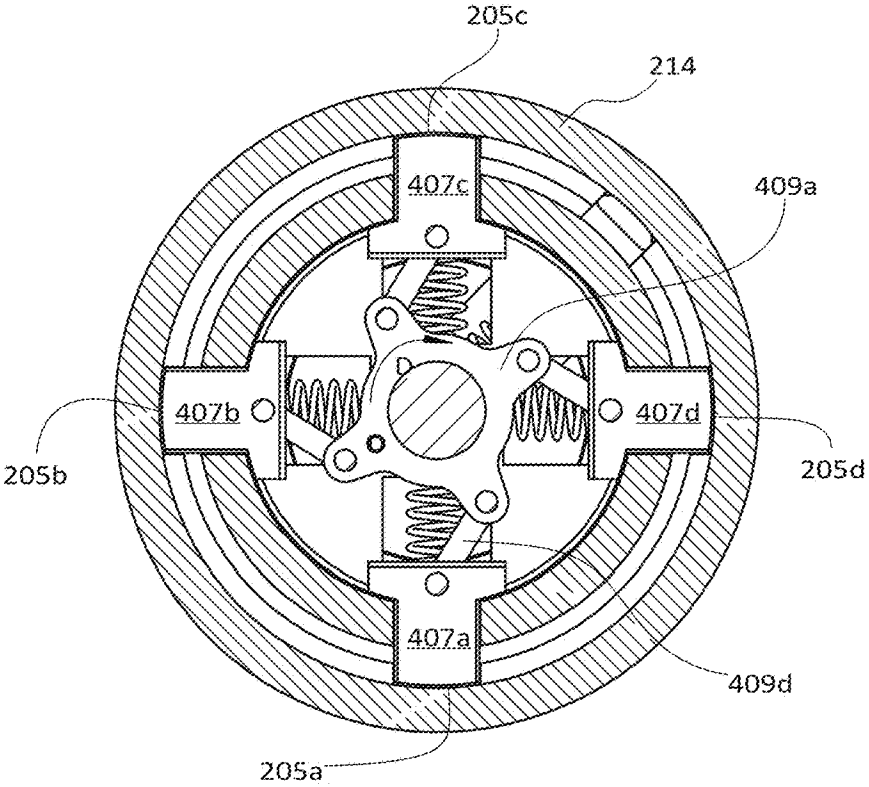
Figure 13C:
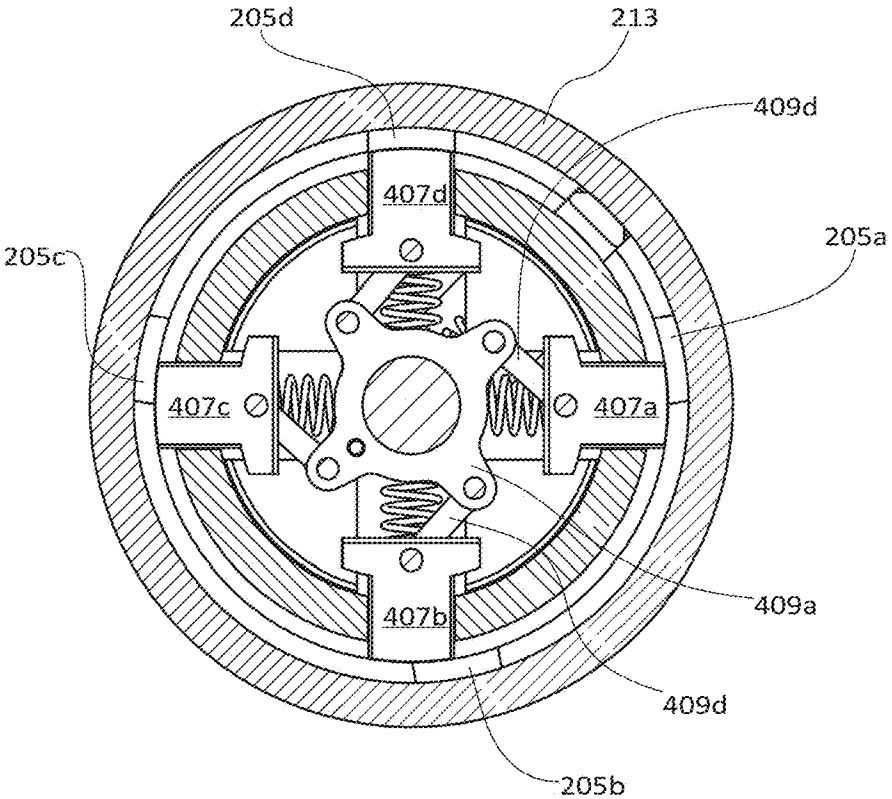

FIGS. 13C and 13D show an embodiment of the position pilot joint 400 passing through another pair of coupling joints 213, 214. The cross-sectional views of FIGS. 13C and 13D reveal the structure of the synchronizer 409, with each spline tooth 407 attached to the synchronizer by an arm 409*d* pivotally attached to the synchronizer body 409*a*. In FIG. 13C illustrating coupling joint 213, only the spline tooth 407*d* is aligned with the adjacent longitudinal slot 205*d*. However, since none of the other spline teeth 407*a*, 407*b* and 407*c* are aligned with the adjacent longitudinal slots 205*a*, 205*b*, 205*c*, respectively, the synchronizer does not allow the one spline tooth 407*d* to extend into the adjacent slot 205*d*. In contrast, as shown in FIG. 13D illustrating a different coupling joint 214, each of the spline teeth 407*a*-407*d* match their respective adjacent longitudinal slots 205*a*-205*d*, and thus the synchronizer body 409*a* rotates slightly in direction D to allow each spline tooth to synchronously extend into its respective slot. Advantageously, coupling the spline teeth to a synchronizer results in the position pilot joint readily passing through a non-corresponding coupling joint, because the spline teeth 407 are retained in their unextended position, as shown in FIG. 13C, unless all of the spline teeth 407 match a corresponding, adjacent longitudinal slot 205. Additionally, the design of the coupling joint 201, 203, 204, with the guiding slot 302, provides for the automatic rotation of the position pilot joint into the correct angular position, so that the spline teeth 407 will be automatically aligned, and adjacent to, the longitudinal slots 205 of a corresponding coupling joint.

Combinations of different mating features of the longitudinal slots and corresponding spline teeth provide for unique position pilot joint/coupling joint pairs. The example of coupling joints 201, 203 and 204 in FIGS. 2-3C, and coupling joints 211, 212 in FIGS. 13A-13B, each utilize the mating feature of varying widths of the slots and corresponding spline teeth. As shown in FIG. 2, these couplings, for example, are arranged such that the coupling joint 204, having the narrowest width $W_c$, is proximate to the proximate end 200*b* of the casing string 200, and the coupling joint 201 having the widest width $W_a$ of the longitudinal slots 205*a* is at the distal end 200*a* of the casing string 200. Thus, a pilot joint with spline teeth having a width slightly less than the width $W_a$ and greater than the widths $W_b$ and $W_c$, will pass through each of the coupling joints 203, 204 without coupling with those coupling joints, because the spline teeth 407 are too wide to fit into the slots 205 of coupling joints 203, 204. In such embodiments utilizing the mating feature of different widths, the synchronizer 409 in the position pilot joint 400 may not necessarily serve the function of synchronously retaining all of the teeth 407 inside the position pilot joint 406, since none of the teeth 407 will extend through the slots 205 when all of the teeth 407 are wider than the slots 205. The synchronizer 409 additionally serves the function of centralizing the position pilot joint 406 in the center of the casing string by maintaining contact between each of the spline teeth 407 and the inner surface 206*a* of the coupling joint and maintaining a substantially equal distance between the anchor sleeve 406 and the inner surface 206*a* around the circumference of the position pilot joint, even where the inner diameter of the casing string changes between casing string sections. This allows the position pilot joint 400 to avoid getting stuck, which may occur in the absence of a synchronizer 409, for example where one spline tooth 407 extends outwardly of the position pilot joint anchor sleeve 406 and the position pilot joint 400 is not positioned in the center of, and concentric with, the casing string.

Figure 6A:
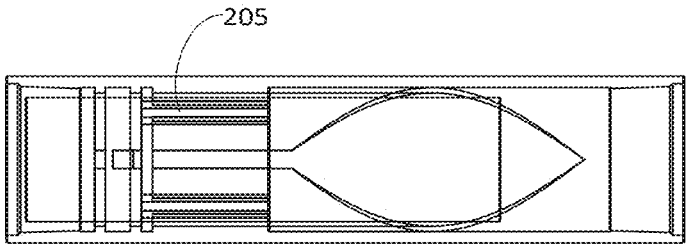
FIGS. 6A and 6B are side elevation views of further embodiments of coupling joints, wherein the length of the slots on each coupling joint is different from the other coupling joint.
Figure 6B:
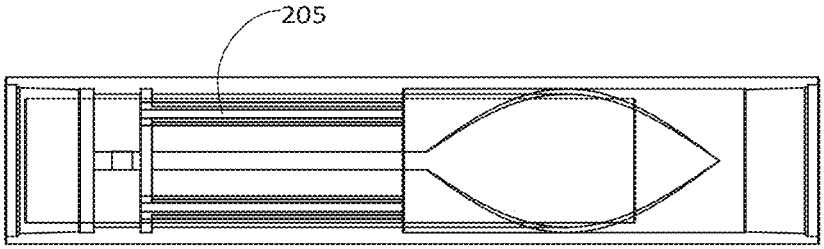
Figure 7A:
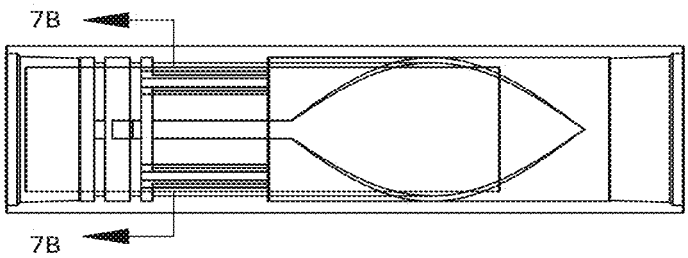
FIGS. 7A and 7C are side elevation views of further embodiments of coupling joints, wherein the width of the slots on each coupling joint is different from the other coupling joint.
Figure 7B:
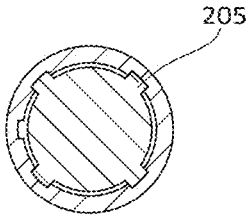
FIGS. 7B and 7D are sectional views taken along lines 7B-7B and 7D-7D of FIGS. 7A and 7C, respectively.
Figure 7C:
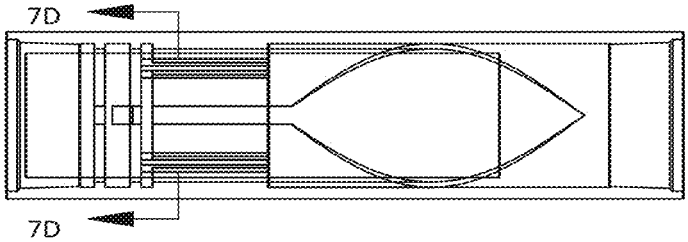
Figure 7D:
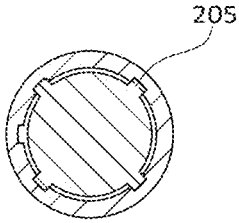
Figure 8A:
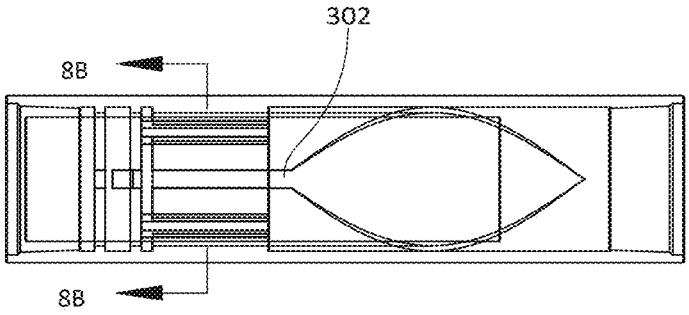
FIGS. 8A and 8C are side elevation views of further embodiments of coupling joints, wherein the angular position of the longitudinal slots relative to the guide block slots on each coupling joint is different from the other coupling joint.
Figure 8B:
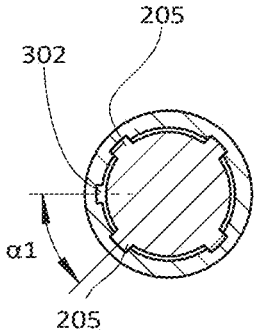
FIGS. 8B and 8D are sectional views taken along lines 8B-8B and 8D-8D of FIGS. 8A and 8C, respectively.
Figure 8C:
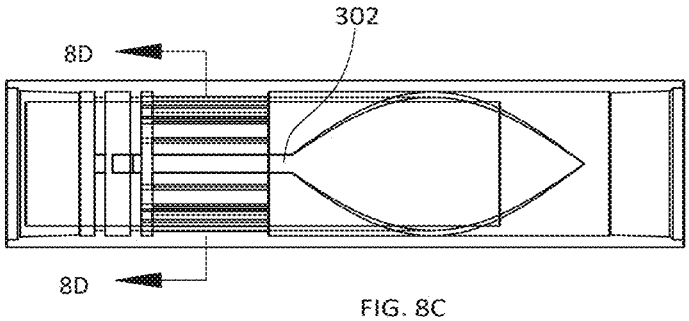
Figure 8D:
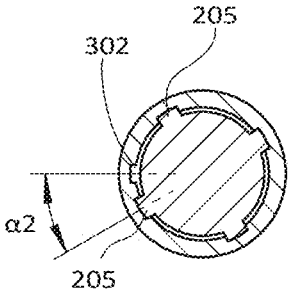
Figure 9A:
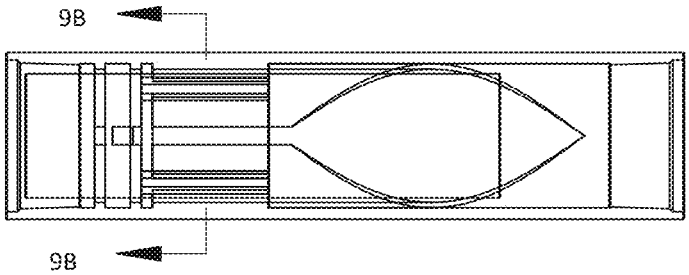
FIGS. 9A and 9C are side elevation views of further embodiments of coupling joints, wherein the number of longitudinal slots on each coupling joint is different from the other coupling joint.
Figure 9B:
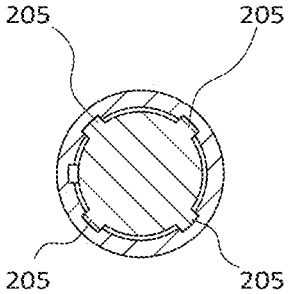
FIGS. 9B and 9D are sectional views taken along lines 9B-9B and 9D-9D of FIGS. 9A and 9C, respectively.
Figure 9C:
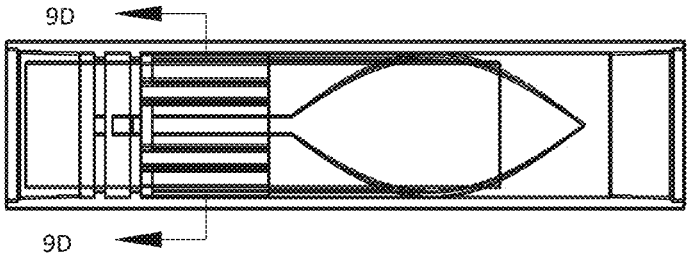
Figure 9D:
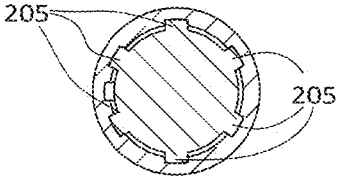
Figure 10A:
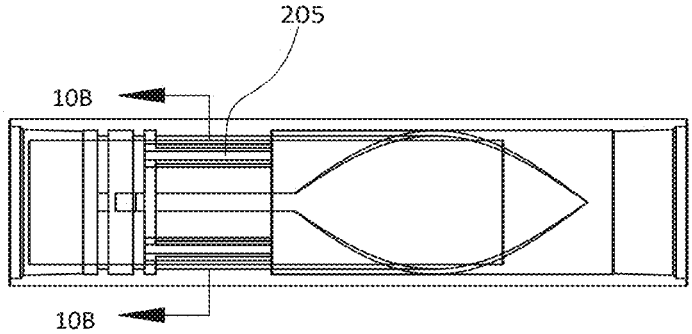
FIGS. 10A and 10C are side elevation views of further embodiments of coupling joints, wherein a combination of the width, length, angular position and number of slots on each coupling joint is different from the other coupling joint.
Figure 10B:
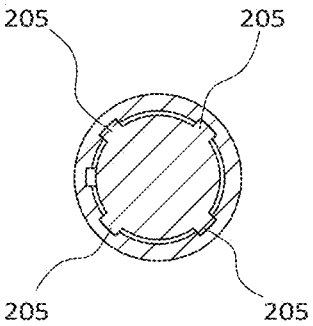
FIGS. 10B and 10D are sectional views taken along lines 10B-10B and 10D-10D of FIGS. 10A and 10C, respectively.
Figure 10C:
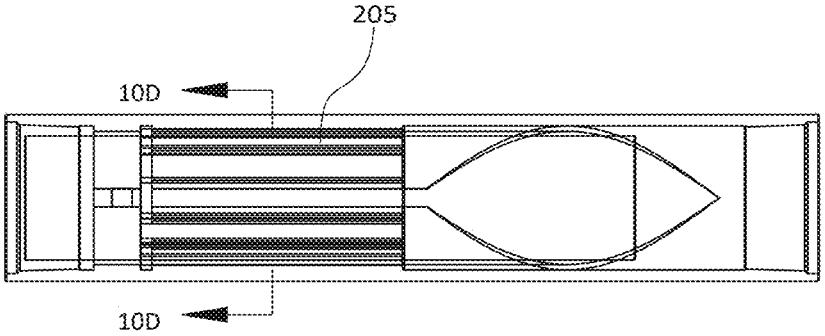
Figure 10D:
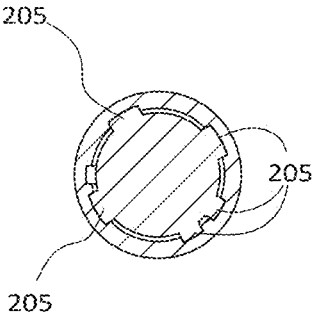

In other embodiments, the mating features of the coupling joint and corresponding position pilot joint may include variances in length of the spline tooth and corresponding longitudinal slot (see FIGS. 6A, 6B where the slot 205 of the coupling joint in FIG. 6A is shorter than the slot 205 of the coupling joint in FIG. 6B); the width of the spline tooth and corresponding longitudinal slot (see FIGS. 7A to 7D, where the slot 205 of the coupling joint in FIGS. 7A, 7B is larger than the width of the slot 205 of the coupling joint in FIGS. 7C, 7D); the angular position of each spline tooth and corresponding longitudinal slot around the circumference, relative to the position of the guide block guiding slot 302 (see FIGS. 8A to 8D, where the angle $\alpha 1$ between the guiding slot 302 and the adjacent longitudinal slot 205 in the embodiment of FIGS. 8A and 8B is larger than the angle $\alpha 2$ in the embodiment of FIGS. 8C and 8D); and the number of spline teeth and corresponding longitudinal slots (see FIGS. 9A to 9D, where the embodiment of a coupling joint in FIGS. 9A and 9B has four longitudinal slots 205 and the embodiment shown in FIGS. 9C and 9D has six longitudinal slots 205); and any combination of these different mating features (see FIGS. 10A to 10D, where the embodiment shown in FIGS. 10A, 10B has four longitudinal slots 205 having equal widths and evenly distributed around the circumference, which is differentiated from the embodiment shown in FIGS. 10C, 10D having five longitudinal slots of varying widths and not evenly distributed around the circumference, and having a slot length that is longer than the slot length of the embodiment shown in FIGS. 10A, 10B).

Modular and Adaptable Position Pilot Joints

Figure 14B:
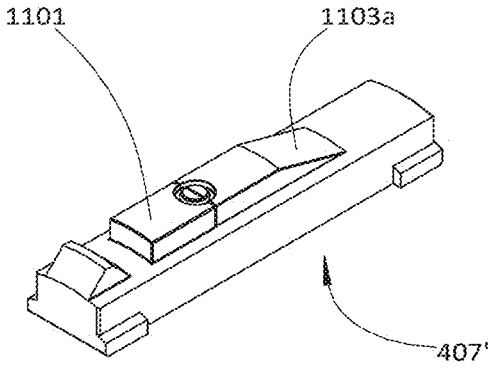
FIGS. 14A to 14C are perspective views of embodiments of a modular spline tooth assembly.
Figure 14C:
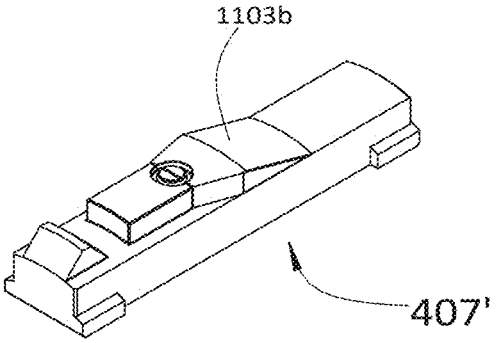
Figure 14A:
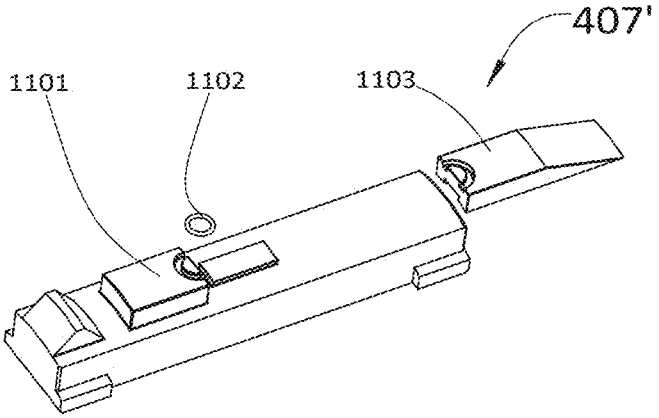
Figure 15A:
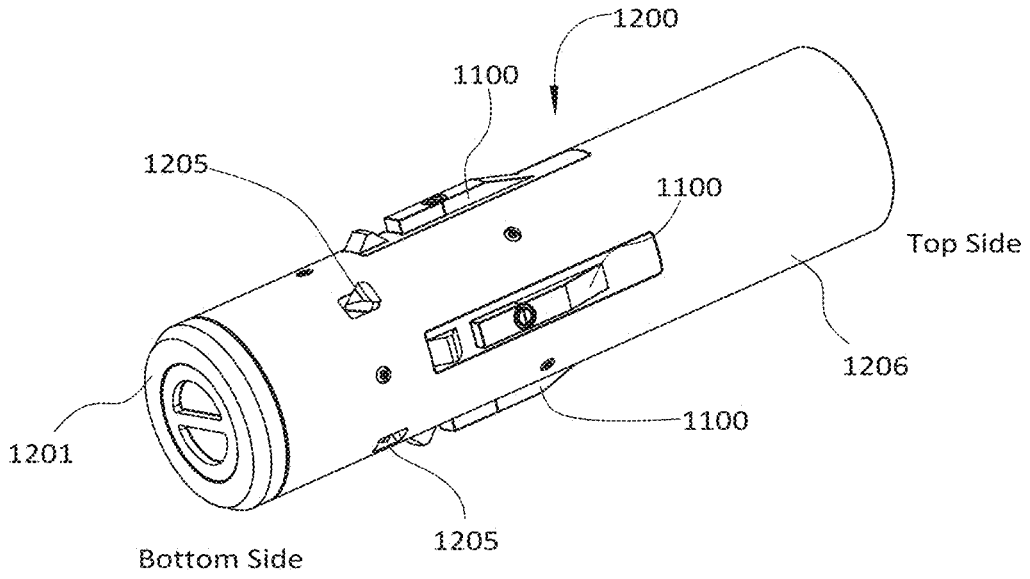
FIG. 15A is a perspective view of an embodiment of an adaptable position pilot joint featuring modular spline teeth.
Figure 15B:
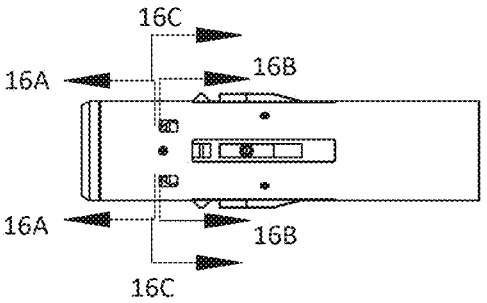
FIG. 15B is a front elevation view of the position pilot joint illustrated in FIG. 15A.
Figure 16A:
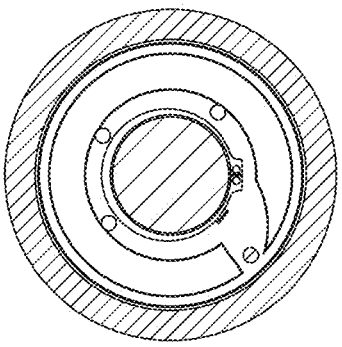
FIG. 16A is sectional view of the position pilot joint, taken along line A-A in FIG. 15B.
Figure 16B:
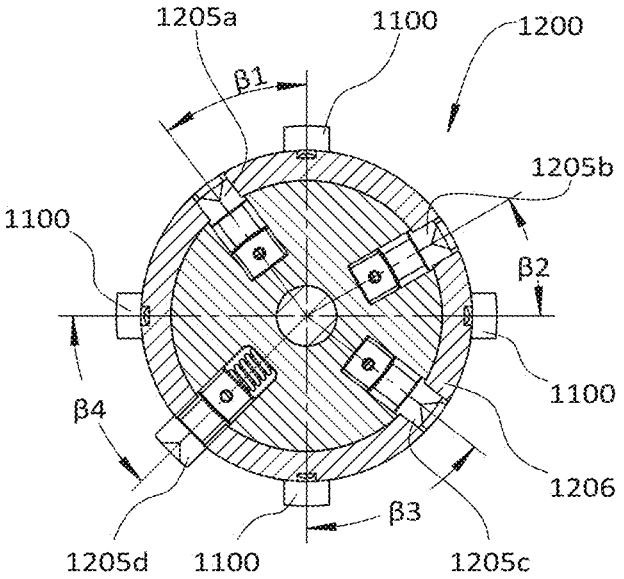
FIG. 16B is sectional view of the position pilot joint, taken along line B-B in FIG. 15B.
Figure 16C:
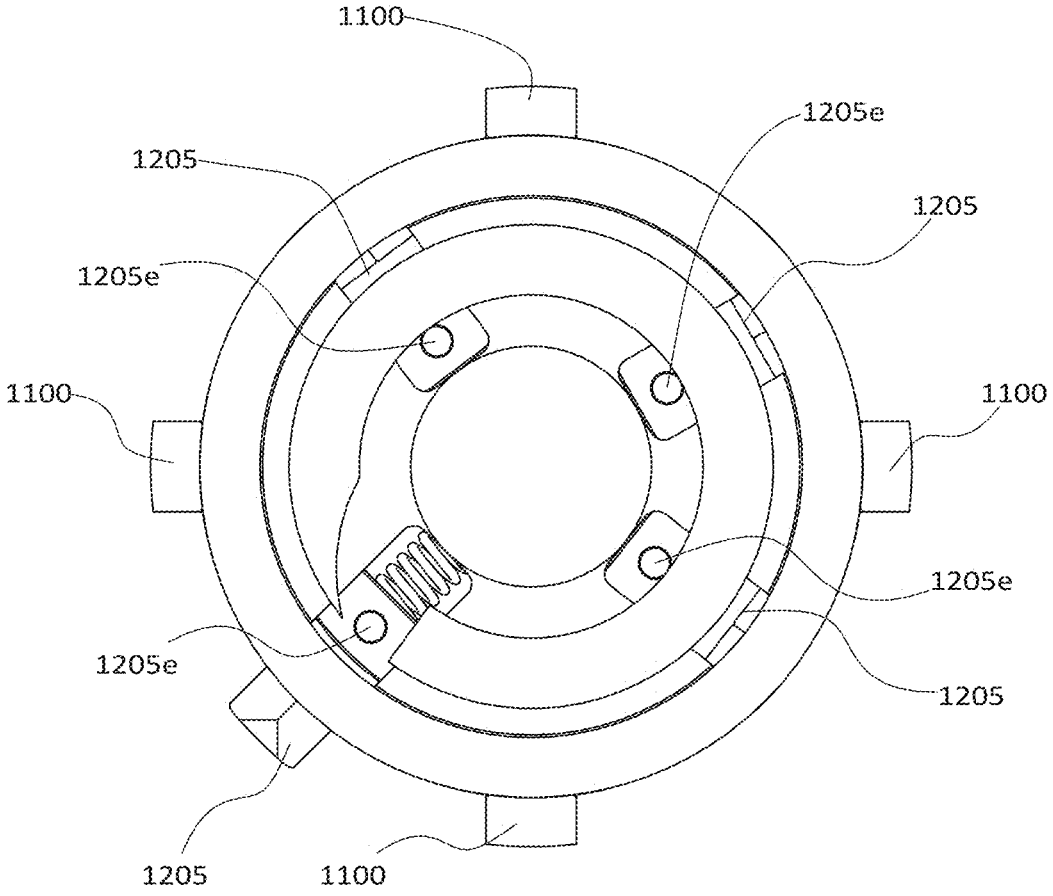
FIG. 16C is a sectional view of the position pilot joint shown in FIG. 15B.
Figure 17:
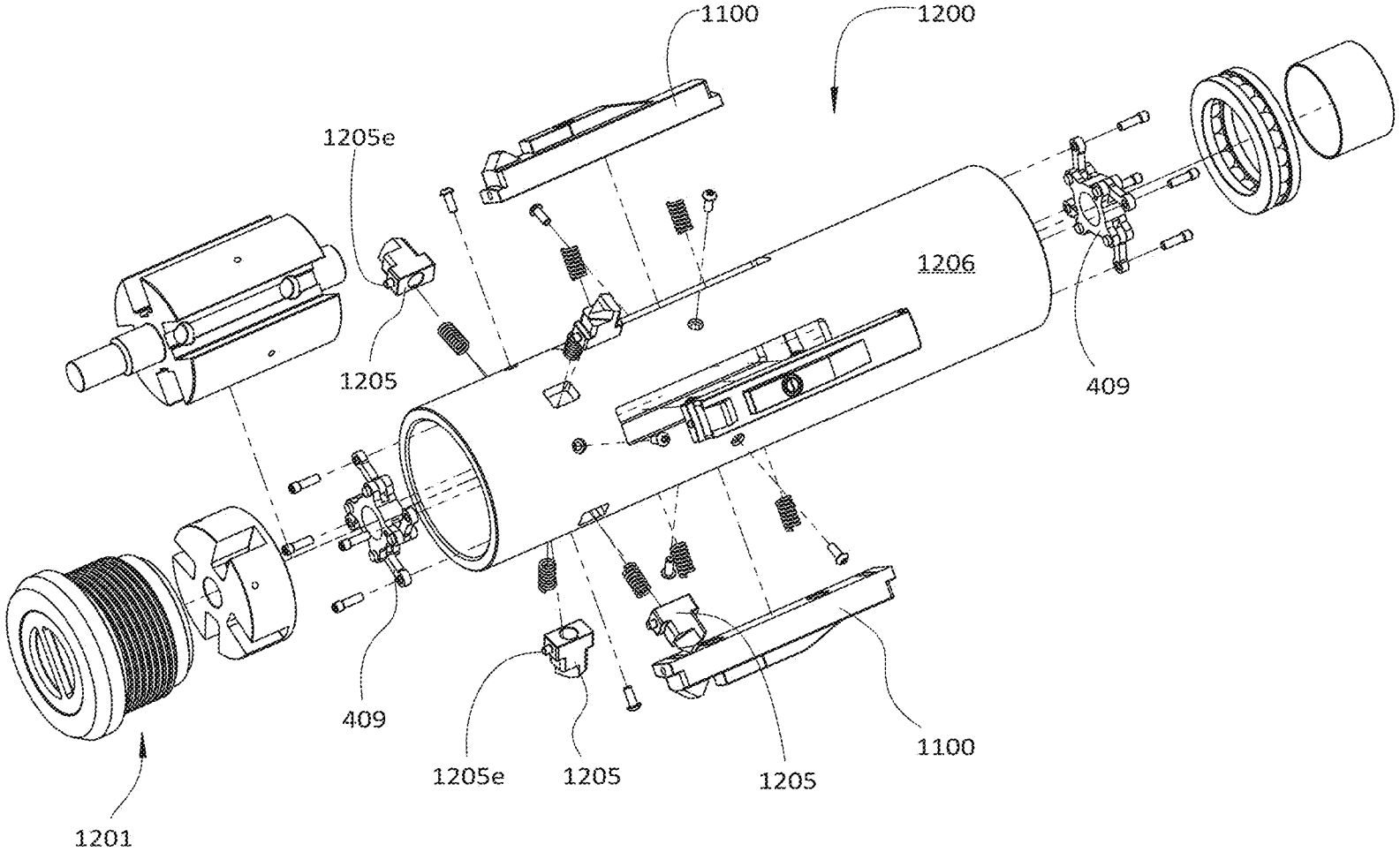
FIG. 17 is an exploded, perspective view of the position pilot joint illustrated in FIG. 15A.
Figure 18:
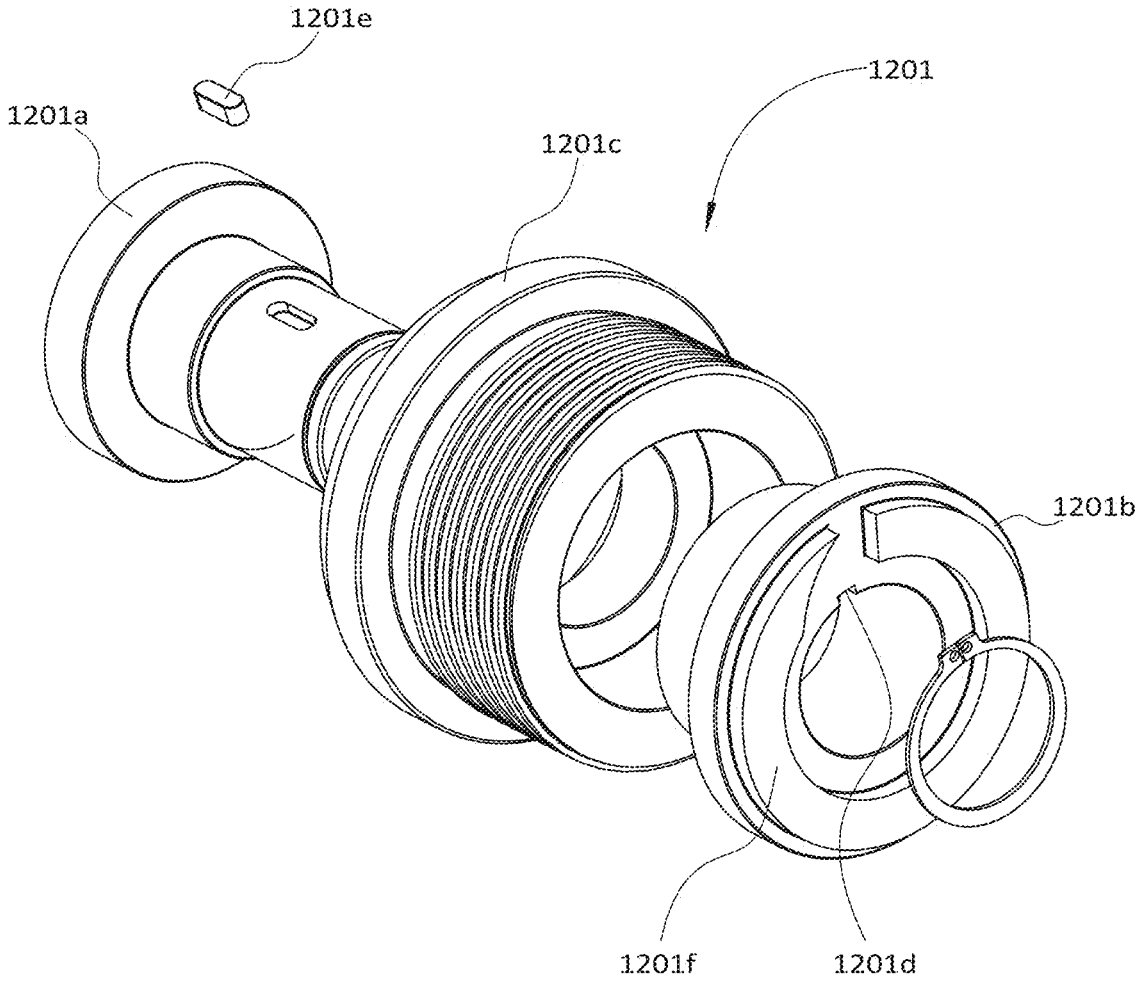
FIG. 18 is an exploded, perspective view of the knob cover assembly of the position pilot joint illustrated in FIG. 17.

In some embodiments the position pilot joint may include a modular design, allowing for the spline teeth of the position pilot joint to be adapted to correspond with the longitudinal slot configuration of a particular coupling joint. For example, referring to FIGS. 14A to 14C, each spline tooth 407' may be modular, having a tooth body 1101 coupled to an exchangeable tail tooth 1103 by a retaining ring 1102. As shown in FIGS. 14B and 14C, a narrow tail tooth 1103*a* may be exchanged for a wider tail tooth 1103*b*, to adapt the spline tooth 407' for mating with narrower or wider longitudinal slots 205 on a coupling joint. Similarly, although not shown in the figures, the exchangeable tail teeth 1103 may have different lengths, so as to provide modular spline teeth having adaptable spline tooth lengths.

FIGS. 15A to 18 illustrate an embodiment of an adaptable position pilot joint 1200 that may be readily reconfigured to change the relative angle between the spline teeth 1100 and the guide block 1205. As shown in FIG. 16B, the adaptable position pilot joint 1200 includes a plurality of guide blocks 1205, wherein the relative angular positions of each spline tooth 1100, relative to a particular guide block 1205, are different. For example, guide block 1205*a* may have an angle $\beta_1$ relative to the adjacent spline tooth 1100, and similarly, angles $\beta_2$, $\beta_3$ and $\beta_4$ between each guide block 1205*b* to 1205*d*, respectively, wherein each angle $\beta_N$ is different from all of the other angles. Thus, by selecting one of the guide blocks 1205 to protrude from the anchor sleeve 1206 while retaining all of the other guide blocks 1205 within the sleeve 1206, the angular position of each spline tooth 1100 relative to the selected guide block 1205 may be changed.

In the embodiment of the adaptable position pilot joint 1200 illustrated in FIGS. 15A to 18, the knob assembly 1201 includes a knob 1201*a*, the knob 1201*a* journaled through a guide block locker 1201*b* and cover 1201*c*. The guide block locker 1201*b* includes a keyway 1201*d* that engages a flat key 1201*e* on the knob 1201*a*. Thus, rotating the knob 1201*a* causes the guide block locker 1201*b* to rotate. Additionally, the guide block locker 1201*b* includes a spiral lip 1201*f* on the distal end surface of the knob assembly 1201, distal from the knob 1201*a*. As best viewed in FIG. 16C, which provides a cross-section view of the knob assembly 1201 engaging the guide blocks 1205, when the knob 1201*a* is rotated, the spiral lip 1201*f* releases the engagement portion 1205*e* of a guide block 1205 when the knob is rotated to select that guide block, thus allowing the guide block 1205 to protrude outwardly of the sleeve 1206 while the other guide blocks 1205 are retained within the sleeve 1206 because they remain engaged with the spiral lip 1201*f* on the knob assembly 1201.

In the illustrated embodiment, two synchronizers 409, 409 are connected to opposite ends of the elongated spline teeth 1100 and the synchronizers 409, 409 function to allow the four spline teeth 1100 to extend outwardly from the anchor sleeve 1206 and into the corresponding longitudinal slots when all four spline teeth 1100 are aligned with, and adapted to, corresponding longitudinal slots in the coupling joint, such as coupling joint 201, similar to the function of the single synchronizer 409 described above in the position pilot joints 400; however, it will be appreciated that in other embodiments, greater than or fewer than two synchronizers may be used for synchronizing the movement of the spline teeth 1100. In some embodiments, such as the adaptable position pilot joint 1200, having two or more synchronizers 409 for synchronizing the extension of the spline teeth 1100 may help avoid having the spline teeth get stuck in the slot of the anchor sleeve 1206 due to uneven forces being applied at each end of the spline tooth 1100.

Advantageously, adaptable position pilot joints may be used to adapt a single position pilot joint to mate with a plurality of different coupling joints, each coupling joint having unique characteristics. Thus, a plurality of adaptable position pilot joints, each having the same design, may be used and adapted to a plurality of different coupling joints, each coupling joint having a set of unique characteristics that distinguishes each coupling joint from the other coupling joints. Furthermore, an embodiment of the adaptable position pilot joint may have any combination of adaptable characteristics, including but not limited to the adaptable characteristics of spline tooth length, spline tooth width and adaptable angular position of the spline teeth relative to the guide block, as described herein.

Stabilizer Joint

Figure 19A:
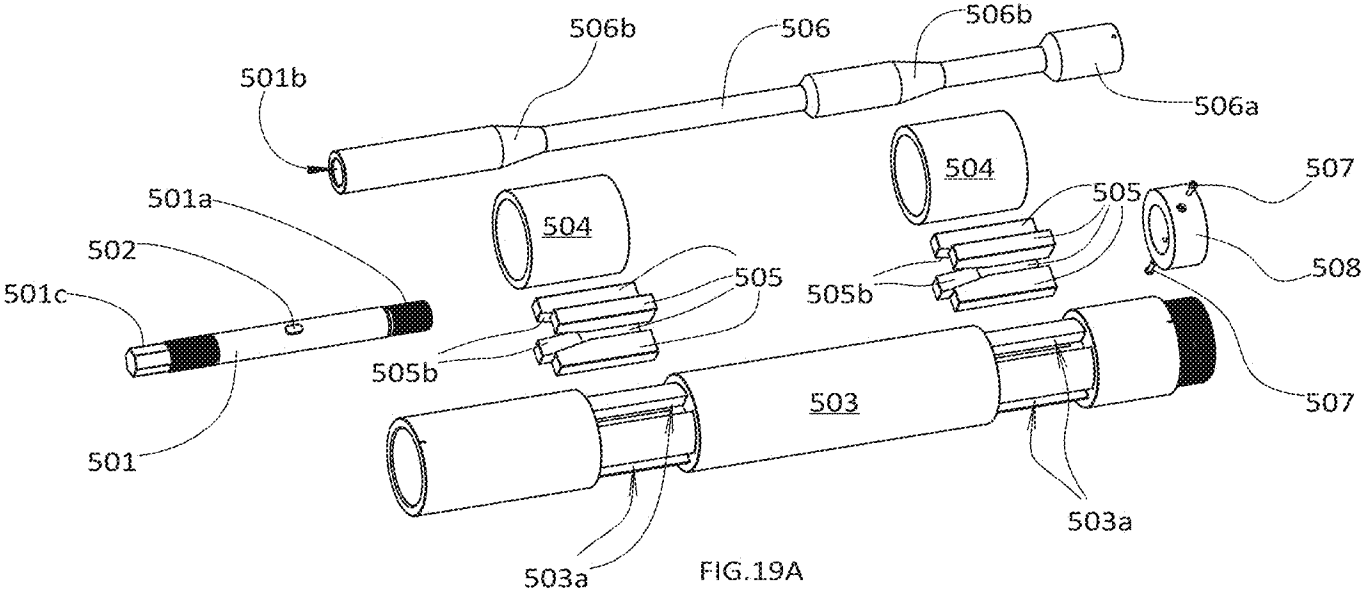
FIG. 19A is an exploded, perspective view of an embodiment of the stabilizer joint.
Figure 19B:
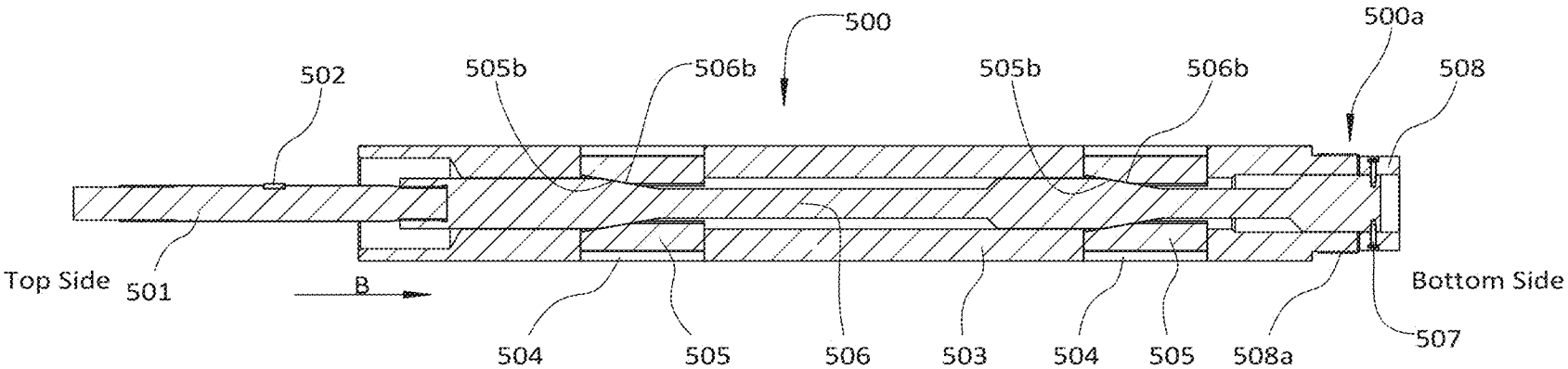
FIG. 19B is an axial section projection view of the stabilizer joint illustrated in FIG. 19A.

As shown in FIGS. 19A and 19B, an embodiment of a stabilizer joint 500 comprises three main components: namely, the core, the pusher sleeve and the pusher assembly. The core comprises a core rod 506 and an azimuth rod 501. The azimuth rod 501 has a flat key 502 projecting from its outer surface. The azimuth rod 501 may be coupled to the core rod 506, for example by means of a threaded coupling 501*a*, 501*b*. At a distal end 506*a* of the core rod 506, distal from the azimuth rod 501, a locating ring 508 is attached to the distal end 506*a* by shear bolts 507. As further explained below, the hex-shaped whipstock end 501*c* of the azimuth rod 501 is received by an internal hex slot 802*a* of the whipstock body 802 of a whipstock tool 800 when the tool assembly 1000 is assembled. The core rod 506 may drive, or be driven by, the clutch control casing 702 of the azimuth joint 700, via the flat key 502 on the azimuth rod 501.

The pusher assembly comprises a plurality of pushers 505, the plurality of pushers held in position within sleeve apertures 503*a* of the pusher sleeve 503 by elastomer rings 504. The core 501, 506 is journaled inside of the pusher sleeve 503, with the shoulders 506*b* of the core rod 506 abutting against a corresponding shoulder 505*b* of each of the plurality of pushers 505 of the pusher assembly, as best viewed in FIG. 19B.

In operation, the core rod 506 is driven by the azimuth rod 501 in the axial direction B, when an axial load is transmitted to the azimuth rod 501 by the whipstock tool 800. When the axial load exceeds the load threshold of the shear bolts, the shear bolts 507 are sheared and core rod 506 is then free to move in direction B relative to the sleeve 503, which causes the shoulders 506*b* of core rod 506 to push against the shoulders 505*b* of the pushers 505, thereby driving the pushers 505 radially outwardly of the sleeve apertures 503*a*. Additionally, when the shear bolts 507 have sheared, the core rod 506 transfers the axial load to the position pilot joint 400 through the locating ring 508. When the pushers 505 are extended radially outwardly of the sleeve 503, the pushers 505 compress the elastomer rings 504 against the casing wall, thereby applying a force to the interior surface of the casing, which causes the stabilizer joint 500 to be releasably anchored inside the casing string. When the core rod 506 is subsequently retracted to release the anchor, the elastomeric rings 504 return to their original configuration, thereby retracting the plurality of pushers 505 back into the sleeve 503 via sleeve apertures 503*a*.

Figure 19C:
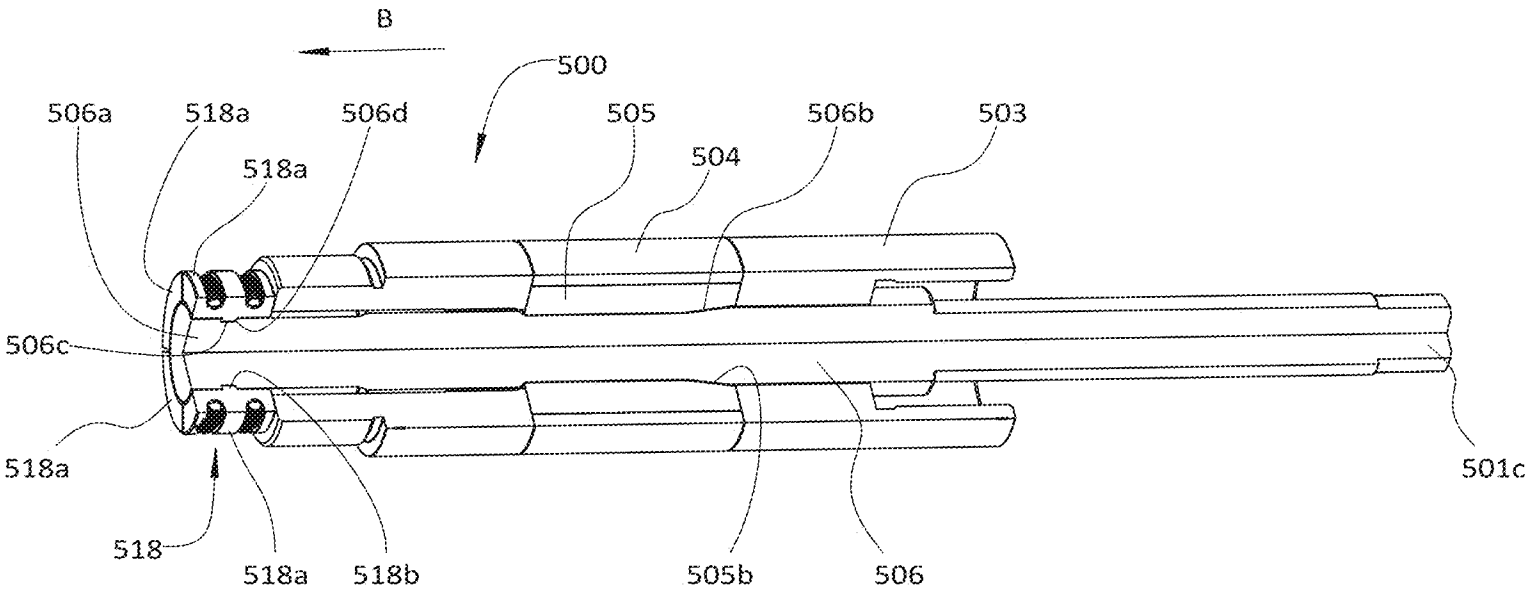
FIG. 19C is a sectional projection view of a further embodiment of a stabilizer joint.

An alternative embodiment of the stabilizer joint 500 is shown in FIG. 19C, whereby the locating ring 508 and shear bolts 507 are replaced by a sectioned ring assembly 518 held in place by resilient members 517, such as coiled springs. In this embodiment of the stabilizer joint, the core rod 506 and azimuth rod 501 are of unitary construction, and there is only one set of pushers 505 held in place by one elastomer ring 504. The distal end 506*a* of the core rod 506 comprises a notch 506*c*, the notch 506*c* including a shoulder 506*d* that mates with a corresponding shoulder on an inner ridge 518*b* of each ring segment 518*a* of the sectioned ring assembly 518. When the axial load transmitted to the azimuth rod 501 and core rod 506 exceeds a load threshold, the shoulder 506*d* on the core rod pushes against the corresponding shoulder of the inner ridge 518*b* on the plurality of ring segments 518*a*, to thereby push the ring segments 518*a* radially outwardly towards the surrounding casing walls, thereby allowing the core rod 506 to move in direction B relative to the sleeve 503. As the core rod 506 moves in direction B relative to the sleeve 503, similar to the embodiment shown in FIGS. 19A and 19B, the shoulders 506*b* of the core rod 506 push against the corresponding shoulders 505*b* of the pushers 505 radially outwardly so that the elastomer ring 504 engages against the casing wall, thereby anchoring the stabilizer joint 500 in place. In this embodiment, when the stabilizer joint 500 is retrieved from the wellbore in the direction opposite to direction B, the segmented ring assembly 518 is re-set, and the stabilizer joint may thereby be re-used without having to install a locating ring 508 with shear bolts 507, as is the case with the embodiment illustrated in FIGS. 19A and 19B.

Azimuth Joint

The azimuth joint 700 allows for the recording of, or setting of, the angular direction of a downhole tool coupled to the tool assembly, such as a whipstock tool 800, relative to the angular position of the guiding slot on the corresponding coupling joint. During drilling operations, the azimuth joint 700 records the angular direction of the downhole tool (such as the whipstock tool 800) relative to the position pilot joint 400 that is engaged with a corresponding coupling joint. When it is desired re-enter a previously drilled lateral wellbore with a downhole tool, for example to clean out the lateral wellbore, to case the lateral wellbore or run coil tubing into the side leg in order to clean it out or perform other maintenance, the azimuth joint 700 is used to set the angular direction of the downhole tool 800 at the surface, so that the whipstock tool is oriented in the correct angular direction for re-entering the targeted lateral wellbore where maintenance is required. This allows a drilling crew to set the whipstock tool and re-enter the horizontal side leg in one step, by attaching (for example) the coil tubing to the whipstock tool (as further explained below), without having to withdraw the downhole tools after the whipstock tool is set. In another aspect, when a side leg is initially drilled, the azimuth joint records the angular position of the orientation of the whipstock tool (or other tools) at the time the whipstock is set, and the recorded angular position is read from the azimuth joint the next time the drilling string is brought to the surface, typically after the side leg has been drilled.

Referring to FIGS. 20A to 20D, an embodiment of an azimuth joint will now be described. In the illustrated embodiment, the azimuth joint 700 utilizes an overdrive clutch mechanism that is a roller overrunning clutch; however, it will be appreciated that other overdrive clutch mechanisms may be used and are intended to be included in the scope of the present disclosure; for example, not intended to be limiting, the overdrive clutch mechanism may be a ball overrunning clutch, a ratchet clutch or a friction disc clutch.

The clutch casing 707 includes, on its outer surface 707*a*, a series of markings 707*b* for indicating the relative azimuth angle of the downhole tool of the tool assembly 1000, relative to the angular position of the guiding slot 302 on the corresponding coupling joint. The clutch casing 707 includes a threaded coupling 708, which may be used for attaching the azimuth joint 700 to a stabilizer joint 500. The two-way overrunning clutch 701 comprises a locked running ring 701*a*, which is coupled to the clutch casing 707, and a free running ring 701*c*, with a plurality of rollers 701*b* allowing the clutch casing 707 to rotate relative to the two-way overrunning clutch 701 when the clutch control sleeve 702 is in the unlocked position, as described below.

Figure 20A:
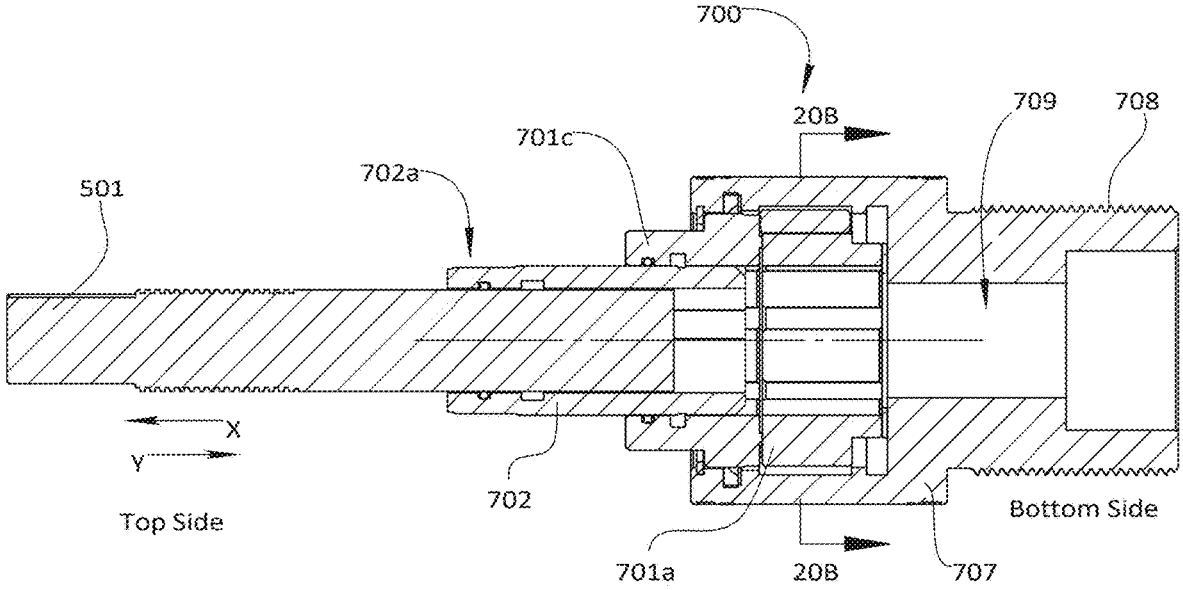
FIG. 20A is a axial section projection view of an embodiment of the azimuth joint.
Figure 20B:
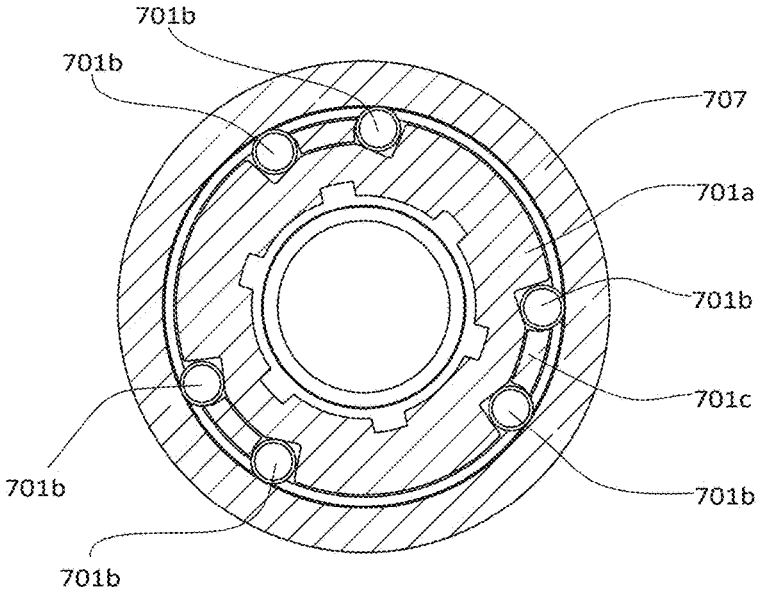
FIG. 20B is a sectional view of the azimuth joint illustrated in FIG. 20A, taken along line 20B-20B of FIG. 20A.
Figure 20C:
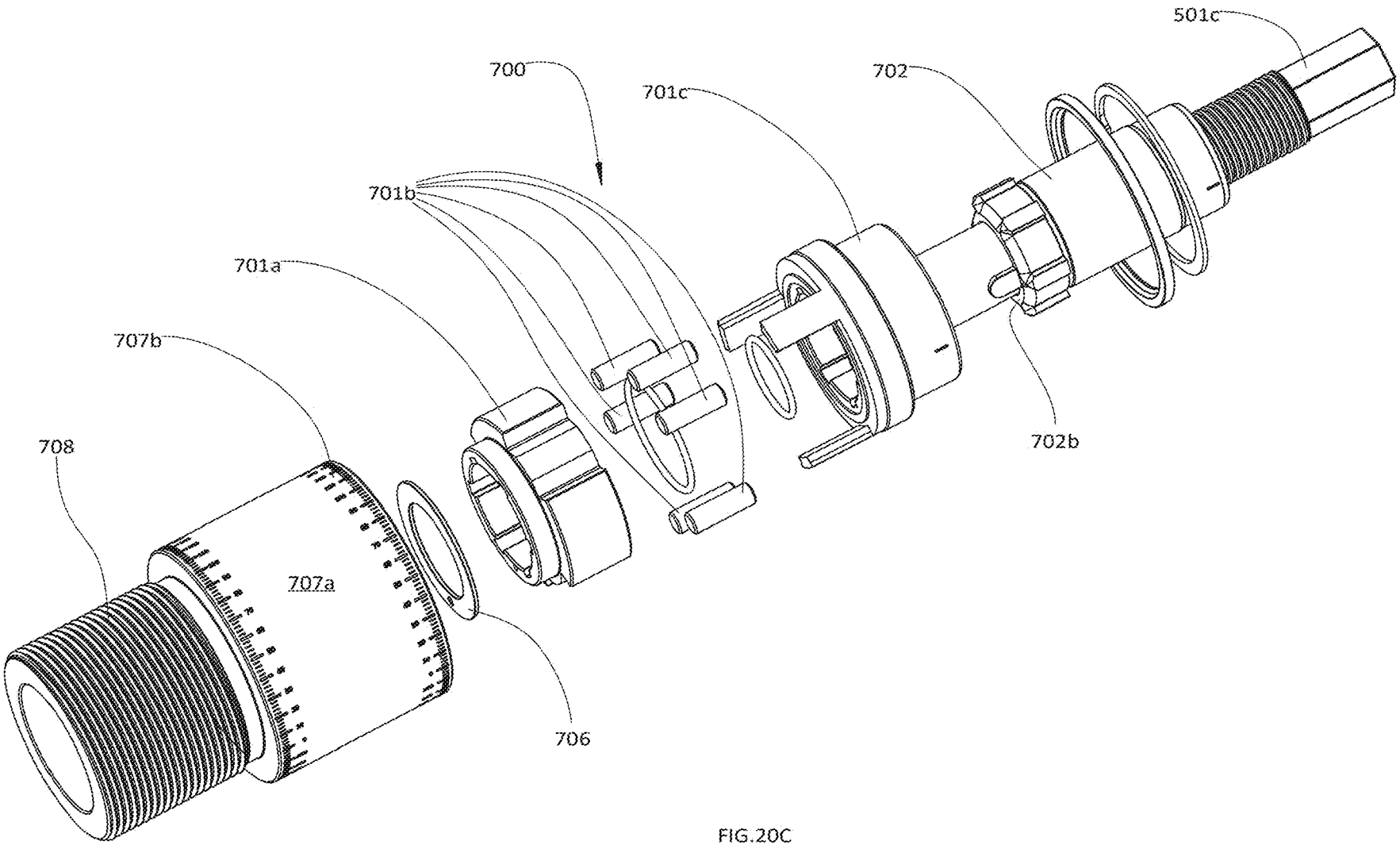
FIG. 20C is an exploded, perspective view of the azimuth joint illustrated in FIG. 20A.
Figure 20D:
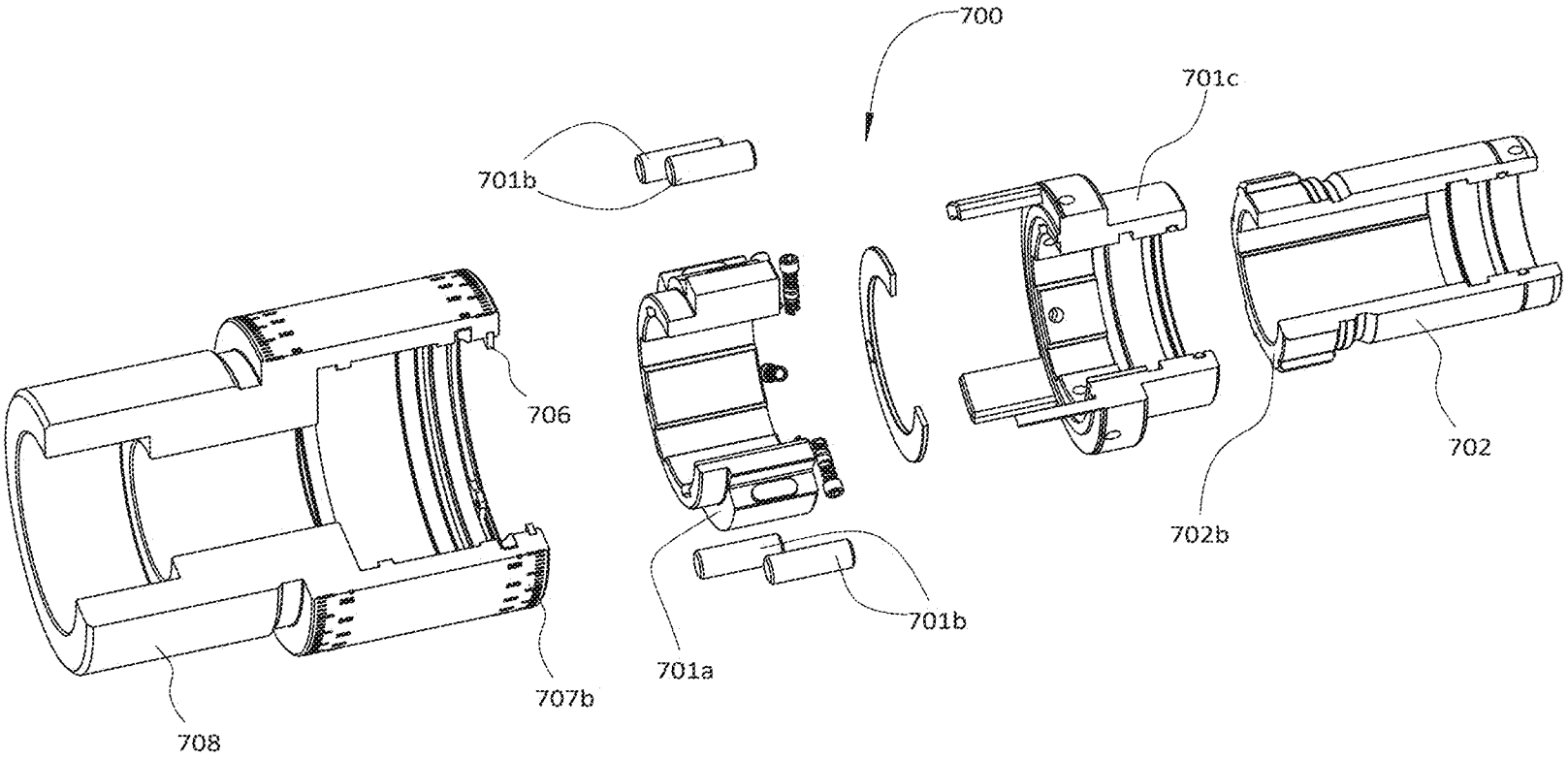
FIG. 20D is a section view of the exploded view of the azimuth joint shown in FIG. 20C.

The clutch control sleeve 702 has two positions, a locked position and an unlocked position, with the unlocked position shown in FIG. 20A. The unlocked position occurs when the clutch control sleeve 702 slides in direction X so that it only engages with, and drives, the free-running ring 701*c* of the overrunning clutch 701. When the clutch control sleeve 702 is in the unlocked position, the rotary speed of the clutch casing 707 may be different from the rotary speed of the two-way overrunning clutch 701. The clutch control sleeve 702 is in the locked position when it slides in direction Y, so as to engage and drive the locked running ring 701*a*, such that the clutch control sleeve 702 drives both the free-running ring 701*c* and the locked running ring 701*a*. With the clutch control sleeve 702 in the locked position, the rotary speed of the clutch control casing 707 would be equal to the rotary speed of the overrunning clutch 701.

Whipstock Tool

Figure 21:
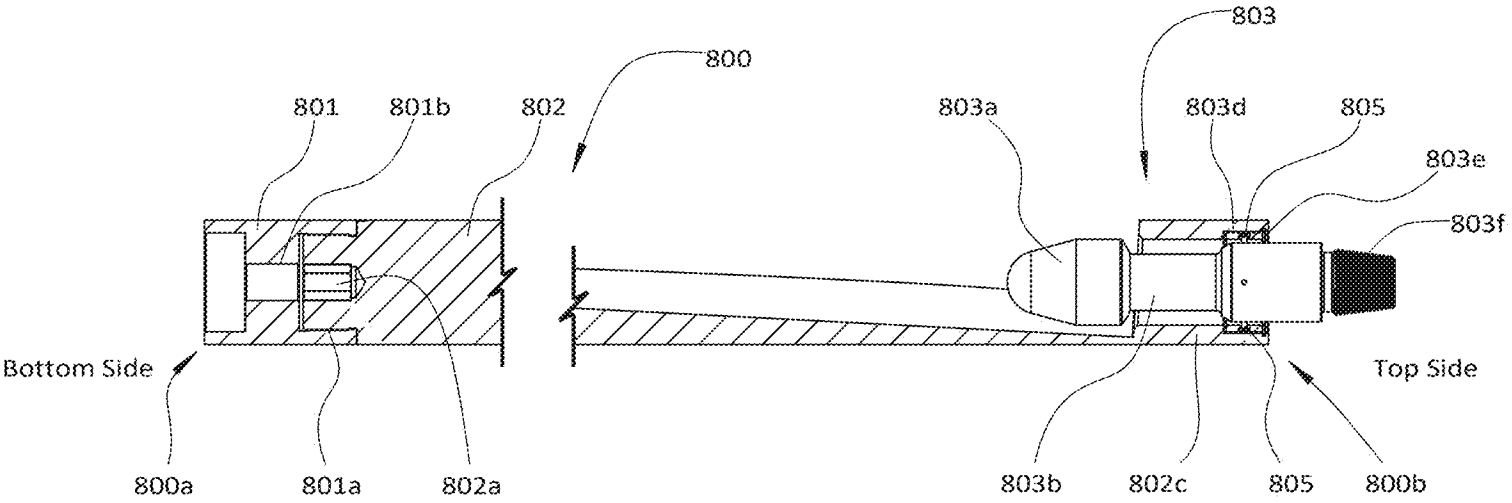
FIG. 21 is a axial section projection break view of an embodiment of the whipstock tool, the embodiment including a joint for attaching coil tubing to the whipstock tool.
Figure 22B:
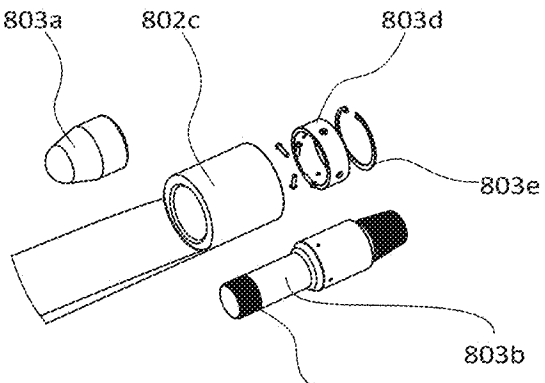
FIG. 22B is an exploded, perspective view of the coil tubing coupling portion of the whipstock tool illustrated in FIG. 21.
Figure 22A:
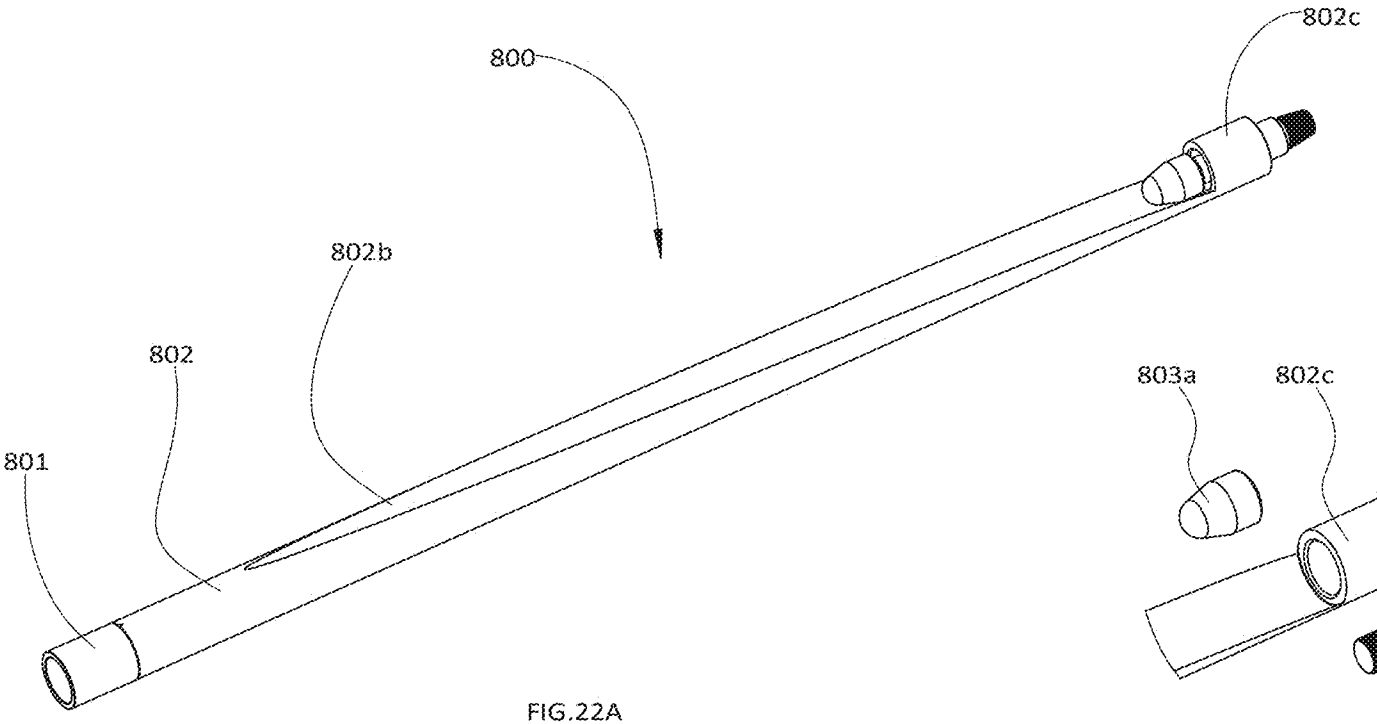
FIG. 22A is a perspective view of the whipstock tool illustrated in FIG. 21.
Figure 23:
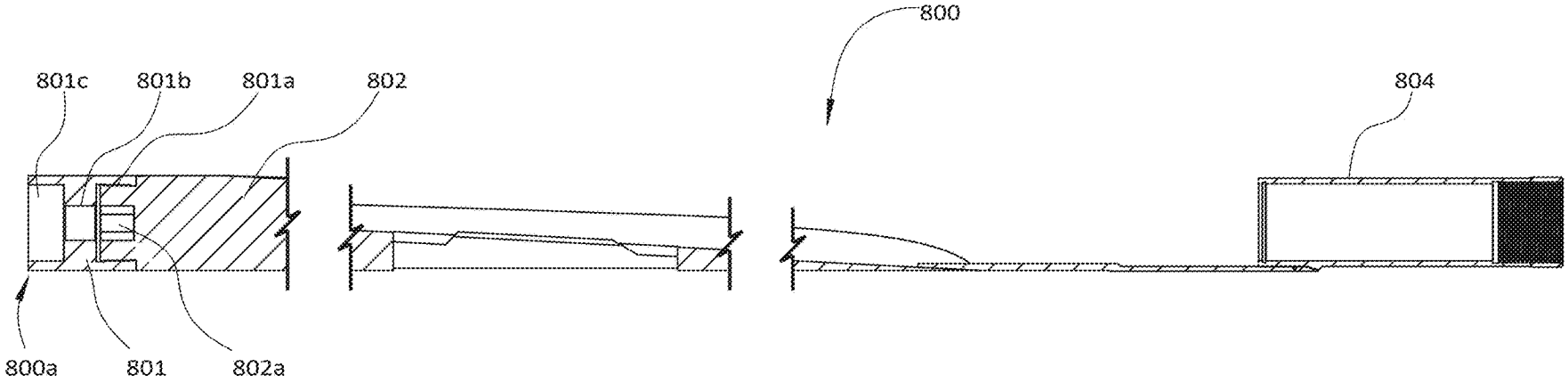
FIG. 23 is a axial section projection view of an embodiment of the whipstock tool, the embodiment including a joint for attaching a drill motor to the whipstock tool.
Figure 24A:
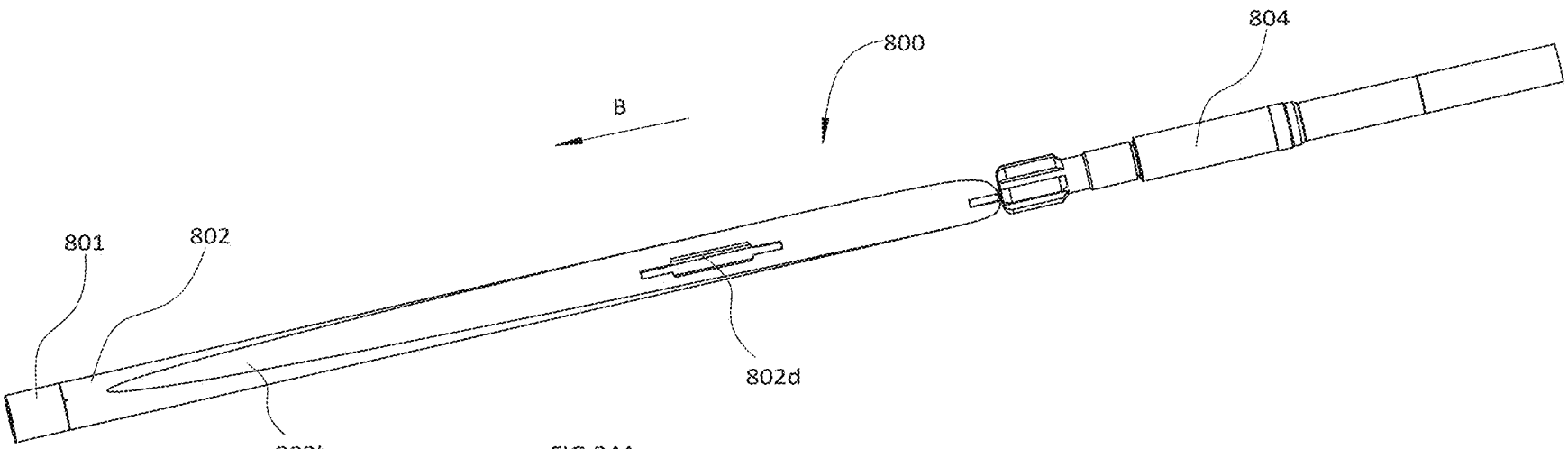
FIG. 24A is a perspective view of the whipstock tool illustrated in FIG. 23, connected to a drill motor.
Figure 24B:
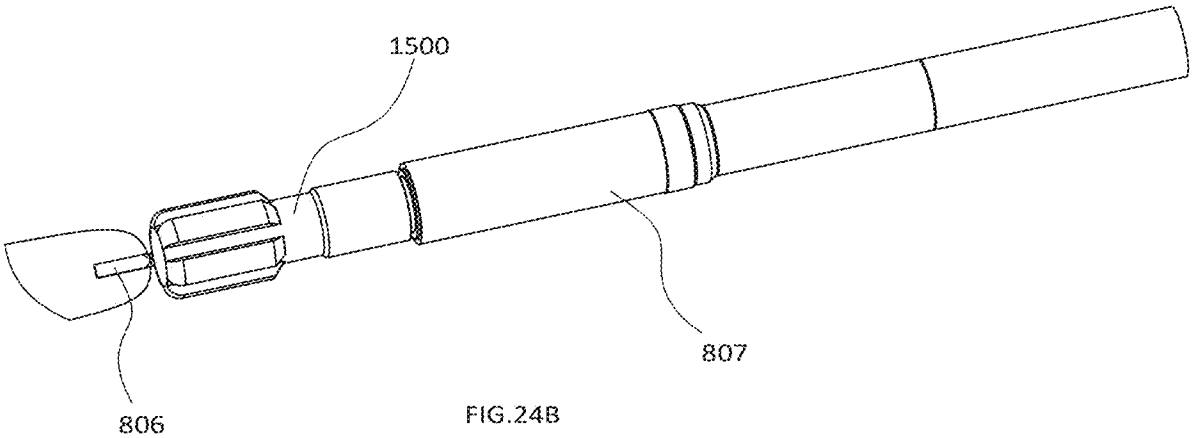
FIG. 24B is a close up perspective view of the joint for attaching a drill motor to the whipstock tool illustrated in FIG. 24A.
Figure 24C:
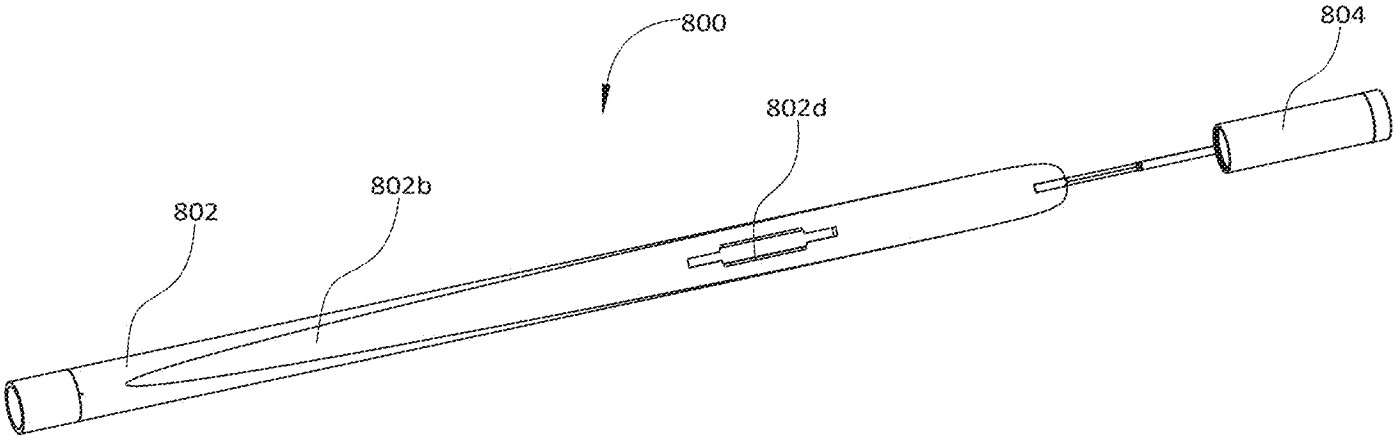
FIG. 24C is a perspective view of the whipstock tool illustrated in FIG. 23.
Figure 24D:
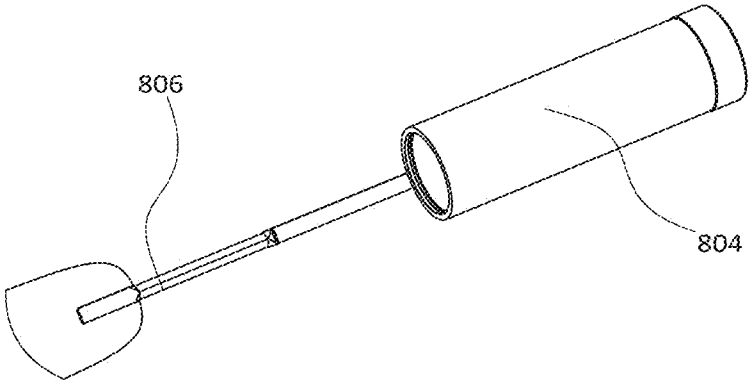
FIG. 24D is a close up perspective view of the joint for attaching a drill motor to the whipstock tool illustrated in FIG. 24C.

FIGS. 21 and 22 illustrate an embodiment of a whipstock tool for use with coiled tubing, while FIGS. 23 and 24 illustrate an embodiment of the whipstock tool for use with a drilling motor. The whipstock body 802 includes an inner hex slot 802*a* at a distal end 800*a* of the whipstock tool 800, distal from the surface. The inner hex slot 802*a* receives the hex-shaped end of the azimuth rod 501 of the stabilizer joint 500, thereby transferring the torque from the azimuth rod 501 to the whipstock body 802. Additionally, the whipstock tool 800 includes a locking portion 801, the locking portion 801 having two threaded couplings; the first threaded coupling 801*a* for coupling the locking portion 801 to the whipstock body 802, and the second threaded coupling 801*b* for coupling the locking portion 801 to the azimuth rod 501.

The whipstock tool, when configured for use with a drill motor as illustrated in FIGS. 23 and 24, has a drill motor coupling apparatus 804 which couples to a conventional drill motor via an extension rod 806, a joint sleeve 807 and shear pins (not shown). When the whipstock tool is landed and locked in its position, the axial force applied to the drill string would continue to increase until it exceeds the load threshold of the shear pins, thereby releasing the drill motor from the extension rod 806. The drill motor would then continue moving downhole, in direction B, to be guided along the wedge portion 802*b* of the whipstock body 802 so as to drill the horizontal leg of the well. Once drilling of the horizontal leg is completed, the drill motor would be pulled out independently of the whipstock tool 800, after which the whipstock tool would be pulled out using a fishing tool as would be known to a person skilled in the art.

The whipstock tool, when configured for use with coil tubing as illustrated in FIGS. 21 and 22, has a coil tubing coupling apparatus 803 for coupling to the coil tubing. The whipstock body 802 includes a ringtail 802*c* at the proximal end 800*b* of the whipstock tool 800, proximate to the surface when the whipstock tool is downhole. The ringtail 802*c* may be temporarily coupled to the coil tubing coupling apparatus 803, which apparatus 803 may be released when the shear bolts 805 are sheared.

The coil tubing coupling apparatus 803 comprises a fishing head 803*a*, coupled to a joint body 803*b* via a threaded coupling 803*c*. When the fishing head 803*a* is coupled to the joint body 803*b*, the fishing head 803*a* cannot pass through the ring tail 802*c* of the whipstock body 802, which allows for fishing out the entire whipstock tool when maintenance is completed. The joint body 803*b* may be fastened to a free-spinning ring 803*d* via shear bolts 805, with the free-spinning ring 803*d* mounted within the ringtail 802*c* of the whipstock body and retained therein by a retaining ring 803*e*. Once the whipstock tool 800 is landed and locked into position, the axial force applied to the proximate end 800*b* of the whipstock tool 800 continues to increase until it exceeds the load threshold of the shear bolts 805, at which points the shear bolts will be sheared and thereby release the joint body 803*b* from the free-spinning ring 803*d*, thereby allowing the coil tubing attached to the coil tubing coupling end 803*f* of the joint body 803*b* to run forward and be guided along the wedge portion 802*b* of the whipstock tool 802. The joint body 803*b* may remain permanently attached to the coil tubing, in which case the joint body may be easily replaced for future use of the whipstock tool 800.

Assembly and Operation—Illustrative Example

An illustrative example of using the system to orient and anchor a whipstock tool will now be described. However, it will be appreciated that the individual components of the system, including the coupling joints, position pilot joints, the azimuth joint and the coupling apparatuses for coupling coiled tubing or drill motors to a whipstock tool, are not limited to locating and anchoring a whipstock tool, and that either the entire system or the individual components thereof may be used to locate, orient and/or anchor other types of downhole drilling tools.

With reference to a well plan, the measurement depth of the different side legs that will be drilled from a main vertical wellbore are calculated, and the casing string 200 is then constructed to position the coupling joints 300, which may include for example the coupling joints 201, 202 and 204, at the targeted depths as determined from the well plan. Each coupling joint 300 may have a unique configuration of the angular position of the guiding slot 302 relative to the plurality of longitudinal slots 205, and the plurality of longitudinal slots 205 themselves may also possess a unique combination of guiding features, the combination of such configuration and such features thereby differentiating each coupling joint from the other coupling joints. The guiding features may include any combination of length, width and/or number of slots, and relative angular position of the slots compared to the guiding slot 302 of the coupling joint 300, to make up the unique combination of guiding features. In the embodiment illustrated in FIGS. 2-3C, the guiding features of each coupling joint 201, 203 and 204 are differentiated from each other by slot width $W_a$, $W_b$ and $W_c$, and the coupling joints are arranged in the casing string 200 such that the narrowest slots 205, of coupling joint 204, is proximate to the surface, and the widest slots 205, of coupling joint 201, are distal from the surface. The casing string 200 is then placed downhole.

The drilling string is assembled as follows. With reference to FIGS. 1 to 24, the whipstock tool 800 used in this illustrative example includes the drill motor coupling apparatus 804, illustrated in FIGS. 23 and 24. The drill motor 1500 is coupled to the whipstock tool 800 using the drill motor coupling apparatus 804. The azimuth joint 700 is threadedly coupled to the sleeve 503 of the stabilizer joint 500 via threaded coupling 708. The azimuth rod 501 of the stabilizer joint 500 passes through a central bore 709 of the azimuth joint 700, with the flat key 502 of the azimuth rod 501 aligned with and fitted into an inner slot (not shown) within the clutch control sleeve 702. The hexagon-shaped whipstock end 501*c* of the azimuth rod 501 is received by the inner hexagonal slot 802*a* of the whipstock body 802 of the whipstock tool 800. The free end 702*a* of the clutch control sleeve 702 is partially inserted into the receiving cup 801*c* of the locking portion 801 of whipstock tool 800, with the azimuth joint 700 set in the unlocked position. The distal end 500*a* of the stabilizer joint 500, distal from the surface, is coupled to the threaded coupling 410*a* of the anchor sleeve 406 of the position pilot joint, via threaded coupling 508*a* of the stabilizer joint 500.

Once assembled as above, the assembled tool is run downhole with the drilling string which connects with the drill motor 1500. The axial loads of the drilling string are initially borne by the locating ring 508 of the stabilizer joint, before the position pilot joint 400 engages with its corresponding coupling joint 201, 203 or 204. Thus, before the position pilot joint engages with a corresponding coupling joint, and before the stabilizer joint is set within the casing string, the position pilot joint 400, together with the stabilizer joint 500 and the clutch casing 707 of the azimuth joint 700, are rotating together as the pilot joint 400 rotates with the guide block 402 travelling along the guide ramps 303 and guide slots 302 of the respective coupling joints 300. Meanwhile, as the clutch control sleeve 702 of the azimuth joint 700 remains in an unlocked position, the position pilot joint 400, stabilizer joint 500 and clutch casing 707 of the azimuth joint are free to rotate independently of the whipstock tool 800. At this time, while the azimuth joint 700 remains in the unlocked position, the locked running ring 701*a* and the free running ring 701*c* of the azimuth joint 700, the core rod 506 of the stabilizer joint 500, the azimuth rod 501 and the whipstock tool 800 are rotating at the rotational speed of the drilling string, and are rotating independently of the position pilot joint 400, stabilizer joint 500 and the clutch casing 707 of the azimuth joint.

The position pilot joint 400 initially encounters the first coupling joint 204 while travelling downhole in direction B. The guide block 402 of position pilot joint 400 moves in and out of the anchor sleeve 406 as it remains in contact with the interior surface of the OCTG 202 and the coupling joints 300. Upon encountering the first coupling joint 204 in the casing string 200, the Mule Shoe portion 301 of the coupling joint 204 guides the guide block 402 along the ramp edges 303, causing the position pilot joint 400 to rotate along with the guide block 402, thereby causing the relative angle between the azimuth joint 700 and the whipstock tool 800 to change because the clutch casing 707 is rotating with the position pilot joint 400 and the stabilizer joint anchor sleeve 503, while the whipstock tool 800 is rotating independently of these components. The position pilot joint 400 will stop rotating once the guide block 402 slides into the guiding slot 303 of the coupling joint. At the same time, the spline teeth 407 of the position pilot joint become aligned with the longitudinal slots 205 of the coupling joint 204. However, in this example, because the width of each spline tooth 407 is greater than the width $W_c$ of the slots 205 in coupling joint 204, the spline teeth 407 are retained partially within the anchor sleeve 406 and slide past the longitudinal slots in coupling joint 204, and the position pilot joint 400 passes through the coupling joint 204.

The drilling string continues travelling in direction B until the position pilot joint 400 encounters the next coupling joint 203 in the casing string 200. The guide block 402 again travels along the ramp edges 303 of Mule Shoe portion 301 and enters the guiding slot 303. This time, because the width of the spline teeth 407 have a width that is slightly less than the width $W_B$ of the slots 205 of coupling joint 203, the teeth 407 will extend out of the anchor sleeve 406 and engage the slots 205. The spline teeth 407 will also be prevented from sliding further in direction B by groove edge 304 in coupling joint 203. Thus, with the spline teeth 407 engaged in the slots 205 of coupling joint 203, the position pilot joint 400 stops moving in direction B.

As a result of position pilot joint 400 engaging with coupling joint 203, the axial load applied to the drilling string begins to increase as the weight applied to the string continues to increase at the surface. Once the load exceeds the load threshold of shear bolts 507 in the stabilizer joint 500, the bolts 507 will shear and the core rod 506 will move in direction B, pushed by azimuth rod 501 which is received in the hex slot 802*a* of whipstock tool 800, thereby causing the shoulders 506*b* on core rod 506 to push the pushers 505 to extend laterally outwardly from the stabilizer sleeve 503 and engage the interior surface of the casing string via elastomer rings 504. As the axial load continues to increase, the receiving cup 801*c* of the whipstock tool 800 engages with and pushes the free end 702*a* of the clutch control sleeve 702 in direction B into the locked position, thus locking the azimuth joint 700 and recording the relative angular position between the azimuth joint and the whipstock tool 800, as reflected by the markings 707*b* on the clutch casing 707. Once the clutch control sleeve 702 of the azimuth joint 700 is in the locked position, the azimuth rod 501, and thus the whipstock tool 800, is no longer able to rotate as a result of the flat key 502 of the azimuth rod 501 engaging a slot on the inner surface 702*b* of the clutch control sleeve 702, as best viewed in FIG. 20C.

As the axial load applied to the drilling string continues to increase, once the axial load exceeds the load threshold of the shear pins 805, the shear pins 805 will shear to thereby release the drill motor to move along the wedge portion 802*b* of the whipstock body 802. The drill motor is guided along the wedge portion 802*b* to mill a window in the OCTG, and then the drill motor passes through the milled window to drill the side leg. Once the drilling of the side leg bore is complete, the drill motor is retrieved to the surface, leaving the whipstock tool 800 in place downhole. New casing, slot line casing or OCTG, as the case may be, is then run downhole and guided, by the whipstock tool 800, through the drilled side leg bore. Then, the casing running tool, which is used to hold and run the OCTG into the side leg bore, will be pulled back, and the fishing hook which is assembled on the casing running tool will hook the fishing slot 802*d* on the whipstock body 802, allowing the crew to pull out the whipstock tool 800 in the same trip. Once the whipstock tool 800, azimuth joint 700, stabilizer joint 500 and position pilot joint 400 reach the surface, the angle recorded on the azimuth joint, indicating the angular position of the whipstock tool 800 relative to the guiding slot 302 on the coupling joint 203, is read and recorded. This angle recorded on the azimuth joint 700 allows the crew to know the angular location of the whipstock tool, and thus the angular position of the side leg bore, so that the side leg bore may be re-entered at a future date for servicing.

For running coil tubing into a previously drilled side leg bore, a whipstock tool 800 having a coupling apparatus 803 for coil tubing is used. The procedure is similar to that described above, with respect to using a whipstock tool having a coupling apparatus for a drill motor 804, with the following modifications: firstly, the relative angle between the whipstock tool 800 and the azimuth joint 700 that was previously recorded, is set on the azimuth tool by rotating the clutch casing 707 to align the markings 707*b* that indicate the previously recorded angle that was recorded while drilling the side leg that is to be re-entered, and then pushing the clutch control sleeve 702 in direction Y to the locked position. Then, as previously described, the position pilot joint 400, the stabilizer joint 500 and the azimuth joint 700 are assembled together with the whipstock tool 800 having the coupling apparatus 803 for the coil tubing, and the tool assembly is run down the bore. The position pilot joint 400 is used to locate the desired coupling joint 300, as previously described herein, and then the position pilot joint 400 and the stabilizer joint 500 are locked into place when the position pilot joint 400 has engaged, so as to mate with, the desired coupling joint. In this case as the tools are run down the bore, the whipstock tool 800 is rotating along with the position pilot joint 400 and the stabilizer joint 500 because the azimuth joint 700 is in the locked position. Thus, when the position pilot joint 400 engages with the corresponding coupling joint 203, the whipstock tool 800 is rotated into the correct position for guiding the coil tubing (or other downhole tool) into the side leg bore, according to the recorded angle that was previously set on the locked azimuth joint 700 when the tool assembly was assembled at the surface.

When the coil tube coupling apparatus 803 shears the bolts 805 under increasing axial load, the joint body 803*b* remains attached to the coil tubing. The coil tubing is run along the wedge portion 802*b* of the whipstock tool 800 so as to guide the coil tubing into the targeted side leg bore and the desired maintenance work is performed. Once the maintenance work is completed, the coil tubing and the whipstock tool are pulled out directly using the fishing head 803*a*, which engages the ringtail 802*c* of the whipstock body 802.

Although the method of re-entering a side bore with the system and apparatus described herein is explained with reference to re-entering a previously drilled side leg bore with coil tubing, it will be appreciated by a person skilled in the art that other types of downhole tools may re-enter the side leg bore using the systems and methods described herein, using whipstock tools 800 that are configured for supporting and guiding the desired tools into the side leg bore. For example, not intended to be limiting, the systems and methods described herein may be used to re-enter a side leg bore with a drill motor for cleaning out a side leg bore that has become blocked with debris; or to re-enter the side leg bore with casing, or any other downhole tools as would be known to a person skilled in the art.

What is claimed is:

1. A system for locating a depth of interest, anchoring and orienting a well tool at the depth of interest and recording an angular orientation of the well tool, the angular orientation located laterally of a sub-surface bore beneath the earth's surface, the system comprising:

a casing assembly comprising a plurality of casing lengths and one or more coupling joints, each coupling joint of the one or more coupling joints having a tubular body with two opposing angled guiding ramps projecting inwardly from an interior surface of the tubular body, the two opposing angled guiding ramps converging at a guiding slot, and a plurality of longitudinal recesses adjacent the guiding slot, the plurality of longitudinal recesses for receiving a plurality of spline teeth, a tool assembly comprising a position pilot joint at a distal end of the tool assembly, distal from the earth's surface, the position pilot joint comprising an anchor sleeve, a guide block and the plurality of spline teeth, the guide block resiliently supported so as to extend radially outwardly from an outer surface of the anchor sleeve, and the plurality of spline teeth attached to a synchronizing mechanism, the synchronizing mechanism for maintaining the plurality of spline teeth in a retracted position so as to be retracted inside the anchor sleeve until each splined tooth of the plurality of spline teeth is aligned with a corresponding longitudinal recess of the plurality of longitudinal recesses of a corresponding coupling joint, the position pilot joint mounted to a stabilizer joint at a distal end of the stabilizer joint, distal from the earth's surface, the stabilizer joint including an azimuth rod extending from a proximate end of the stabilizer joint that is proximate to the earth's surface, the azimuth rod operatively connected to a core rod of the stabilizer joint so as to actuate a plurality of packers of the stabilizer joint when an axial load exceeding a threshold is applied to the azimuth rod, a free end of the azimuth rod passing through an axial bore of an azimuth joint and received in a slot of the whipstock tool so as to rotate the azimuth rod when torque is applied to the whipstock tool, and wherein, when the position pilot joint passes through the one or more coupling joints of the casing assembly, the plurality of longitudinal spline teeth and the guide block are each resiliently supported outwardly from the outer surface of the anchor sleeve and in sliding contact with and travelling along the interior surface of the casing assembly, and when the guide block travels along the angled guiding ramp of a coupling joint of the one or more coupling joints and enters the guiding slot on the interior surface of the tubular body, the position pilot joint, the stabilizer joint and a clutch casing of an azimuth joint correspondingly rotate independently of the rotation of the whipstock tool when a clutch of the azimuth joint is in an unlocked position, and when the position pilot joint passes through its corresponding coupling joint of the one or more coupling joints, the plurality of longitudinal spline teeth are synchronously and resiliently pushed radially outwardly of the outer surface of the anchor sleeve to engage the corresponding plurality of longitudinal recesses of the corresponding coupling joint, and wherein, when an increasing axial load on the tool string exceeds the threshold axial load, the core rod of the stabilizer joint actuates the stabilizer packers so as to engage an interior surface of the casing assembly to anchor the whipstock tool at the depth of interest.

2. The system of claim 1, wherein the clutch of the azimuth joint comprises an overdrive clutch mechanism comprising a clutch control sleeve at a proximal end of the azimuth joint, the clutch control sleeve cooperating with the clutch casing at a distal end of the azimuth joint, the clutch casing attached to the proximal end of the stabilizer joint so as to rotate with the stabilizer joint, the clutch control casing including a measurement marking for indicating an azimuth angle of the azimuth joint relative to the guiding slot of the corresponding coupling joint, the clutch control sleeve slidingly attached to the clutch casing to rotate with the clutch casing when in a locked position and to rotate independently of the clutch casing when in an unlocked position, and wherein, when the threshold axial load is applied to the azimuth rod, the locker end of the whipstock tool transmits the threshold axial load to the clutch control casing to actuate the clutch control casing into the locked position to lock and record an azimuth angle of the whipstock tool on the azimuth joint.

3. The system of claim 2, wherein the overdrive clutch mechanism is selected from a group comprising: a roller overrunning clutch, a ratchet clutch, a friction disc clutch.

4. The system of claim 1, wherein each coupling joint includes a plurality of longitudinal recesses having a unique set of characteristics that corresponds to a unique set of characteristics of the plurality of spline teeth of the corresponding position pilot joint.

5. The system of claim 4, wherein the unique set of characteristics is selected from a group comprising: length of the plurality of spline teeth and the corresponding longitudinal recesses, width of the plurality of spline teeth and corresponding longitudinal recesses, angular position of the plurality of spline teeth and corresponding longitudinal recesses relative to a guide block slot of the position pilot joint, number of spline teeth and corresponding longitudinal recesses.

6. The system of claim 1, wherein a number of spline teeth and corresponding longitudinal recesses is selected from a range of between three and six.

7. The system of claim 1, wherein the synchronizing mechanism is selected from a group comprising: a linkage mechanism, a rack and pinion mechanism, a taper fit mechanism, an inclined plane fit mechanism.

8. The system of claim 1 wherein the whipstock tool comprises a coupling apparatus for a drill motor so as to carry and guide the drill motor to drill a lateral well laterally of the sub-surface bore.

9. The system of claim 1 wherein the whipstock tool comprises a coupling apparatus for coil tubing, the coupling apparatus including a fishing head coupled to a joint body, the joint body extending through and attached to a ring tail with releasable fasteners, wherein when the axial load applied to the tool assembly exceeds a release threshold the releasable fasteners release the joint body to allow the fishing head and the coil tubing to travel along the whipstock ramp to enter a targeted lateral bore, and wherein when an upward force is applied to the tool assembly to retract the coil tubing from the lateral bore towards the earth's surface, the fishing head engages the ring tail so as to retrieve the whipstock tool to the earth's surface.

10. The system of claim 1 wherein the position pilot joint is an adaptable position pilot joint, the adaptable position pilot joint comprising a plurality of guide blocks, the plurality of guide blocks operatively engaged with a rotatable knob assembly, the rotatable knob assembly including a spiral lip for releasing one selected guide block of the plurality of guide blocks so as to allow the selected guide block to extend radially outwardly of the anchor sleeve while retaining the other guide blocks of the plurality of guide blocks within the anchor sleeve, so as to change a relative angular position of the plurality of spline teeth and the guide block of the plurality of guide blocks.

11. The system of claim 1 wherein the position pilot joint is an adaptable position pilot joint, wherein the plurality of spline teeth comprise modular spline teeth, each spline tooth of the modular spline teeth comprises a spline tooth body, at least two exchangeable tails with each tail of the at least two exchangeable tails having a characteristic that is different from the characteristics of the other exchangeable tails, and a coupling for coupling the exchangeable tail to the spline tooth body.

12. The system of claim 11 wherein the characteristics of the exchangeable tails are selected from a group comprising: length, width.

* * * * *